US007404764B2

(12) United States Patent
Bozeman

(10) Patent No.: US 7,404,764 B2
(45) Date of Patent: Jul. 29, 2008

(54) WORD BASED LOTTERY GAME

(75) Inventor: Alan Kyle Bozeman, Vivian, LA (US)

(73) Assignee: Scientific Games International, Inc., Newark, DE (US)

( * ) Notice: Subject to any disclaimer, the term of this patent is extended or adjusted under 35 U.S.C. 154(b) by 761 days.

(21) Appl. No.: 10/681,447

(22) Filed: Oct. 8, 2003

(65) Prior Publication Data

US 2005/0059465 A1 Mar. 17, 2005

Related U.S. Application Data

(63) Continuation of application No. 10/662,736, filed on Sep. 15, 2003.

(51) Int. Cl.
*A63F 9/24* (2006.01)

(52) U.S. Cl. ..... 463/17; 463/9; 463/25; 463/40; 273/269; 283/49; 283/903

(58) Field of Classification Search ..... 463/1, 463/9, 16–20, 25–30, 40–43; 273/235, 269; 283/49, 903; 705/14; 379/93.13; 434/156, 434/167

See application file for complete search history.

(56) References Cited

U.S. PATENT DOCUMENTS 4,856,787 A * 8/1989 Itkis ..... 273/237
5,112,050 A * 5/1992 Koza et al. ..... 463/17
5,269,523 A * 12/1993 Boylan et al. ..... 273/138.1
5,613,679 A * 3/1997 Casa et al. ..... 273/138.1
5,772,510 A * 6/1998 Roberts ..... 463/17
5,788,573 A * 8/1998 Baerlocher et al. ..... 463/16
5,921,864 A * 7/1999 Walker et al. ..... 463/9
6,017,032 A 1/2000 Grippo et al.
6,024,641 A * 2/2000 Sarno ..... 463/17
6,080,062 A 6/2000 Olson
6,168,521 B1 1/2001 Luciano et al.
6,241,246 B1 * 6/2001 Guttin et al. ..... 273/139
6,428,412 B1 * 8/2002 Anderson et al. ..... 463/9

OTHER PUBLICATIONS

The official rules of Scrabble as retrieved from website (www.thepixiepit.co.uk/scrabble/rules.html), copyright 1999, 6 pages.*

* cited by examiner

*Primary Examiner*—M. A Sager
(74) *Attorney, Agent, or Firm*—Dority & Manning, P.A.

(57) ABSTRACT

A lottery terminal apparatus and method of playing a word based lottery includes a value input device, a display unit and a lottery input unit for receiving alphabetical game play information wherein the display unit is adapted to visually display the received alphabetical game play information. The lottery terminal unit further includes a controller having a memory and a processor, wherein the controller is operatively coupled to the display unit and is programmed to receive wager data in response to a wager made by a person. The controller and method may assign a prize value to the alphabetical game play information received from the lottery input unit and randomly select an alphabetic sample based on a distribution of choices. The controller may further determine a correlation between the alphabetic sample and the alphanumeric game play information to determine a payout value based on a comparison of the alphabetic sample and the alphanumeric game play information to determine the prize value.

12 Claims, 19 Drawing Sheets

350
LOTTERY
PLAYER PARTICIPATE
352
GAME SPECIFIC SELECTIONS
354
N
Y
AUTOMATICALLY GENERATE
356
Y
N
COMPUTER GENERATES PLAYER'S ENTRY
358
INPUT PLAYER SELECTIONS
360
DISPENSE TICKET TO PLAYER
362
LOTTO / POWERBALL
410
KENO
412
SCRATCH OFF
414
BINGO
416
PICK-3 / PICK-4
418
DISPENSE VALUE
364

WORD BASED LOTTERY GAME

This patent is a Continuation of U.S. patent application Ser. No. 10/662,736, filed on Sep. 15, 2003 and entitled "Word Based Lottery Game" which is hereby incorporated by reference in its entirety.

BACKGROUND

Lotteries and lottery theory are well known in the art. Generally a prize is awarded when an assigned or chosen series of numbers is matched with corresponding numbers that have been randomly chosen.

U.S. Pat. No. 6,168,521 entitled "Video Lottery Game" discloses a video lottery system utilizing multiple player-activated video terminals that are linked to computers performing centralized game draw and accounting functions. Each player places a wager and selects his lottery draw choices. The system enrolls the player in a future lottery game after the player makes his choices. The system automatically draws the lottery numbers. The results of the selected game are displayed at the player's terminal in a manner as to provide the excitement of a real-time game.

U.S. Pat. No. 6,080,062 entitled "Lotto Gaming Apparatus and Method" discloses an individual electronic system adapted for playing a Lotto game. The electronic system is configured to rapidly acknowledge a player's win or loss status. The player plays his/her selected numbers against the electronic lotto gaming apparatus randomly generated win numbers. In addition, the lotto gaming apparatus can transfer and receive lotto game information to a central processing system which is capable of handling multiple players from multiple lotto gaming apparatus either within a certain gaming facility or state wide, nationally or internationally. Moreover, the system is configured to allow individual players of the lotto game to access and rapidly determine their win status via an electronic telecommunications network such as the Internet.

U.S. Pat. No. 6,017,032 entitled "Lottery Game" discloses two or more different denominational levels for game tickets, i.e., two or more groups of tickets with tickets in each group being priced differently from tickets in the other groups. All tickets in any one group are priced identically to one another. Wagers received from each ticket group are placed in a corresponding jackpot pool according to the denominational level or amount of the tickets sold for that pool. All wagers for each denomination are processed by a single central controlling authority, with wagers being distributed to each separate pool according to the corresponding wager denomination. Thus, the present game provides a series of different and separate jackpot pools corresponding to each ticket price or denominational level. Jackpots or prizes are awarded from each pool to the winning bettor holding a ticket corresponding to that denominational level and jackpot. Alternatively, the pools are combined and divided in accordance with the total amount of each wager denominational level group. The game is played for a predetermined period of time, or to a predetermined date, or through the sales of a predetermined number of tickets in a given denominational group or groups, as desired. Prizes (e.g., automobiles, etc.) are awarded in addition to money, at the higher or highest denominational levels. A percentage of each pool, or of the combined total, is retained by the operating authorities for overhead, charitable or government use, etc., if so desired.

SUMMARY

The present invention comprises a system, apparatus and method providing a word-based lottery game for play on a lottery terminal unit and a casino gaming unit.

A lottery terminal apparatus includes a value input device, a lottery input unit for receiving alphabetical game play information and a display unit for visually displaying the alphabetical game play information received from the lottery input unit. The lottery terminal apparatus further includes a controller operatively coupled to the display unit and the value input device, wherein the controller includes a processor and a memory operatively coupled thereto, wherein the controller is programmed to receive wager data in response to a wager made by a person and assign a prize value to the alphabetical game play information received from the lottery input unit. The controller may further be programmed to randomly select an alphabetic sample, and determine a correlation between the alphabetic sample and the alphanumeric game play information to determine a payout value based on the correlation between the alphabetic sample and the alphanumeric game play information and the prize value.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Lottery Network

Figure 1:
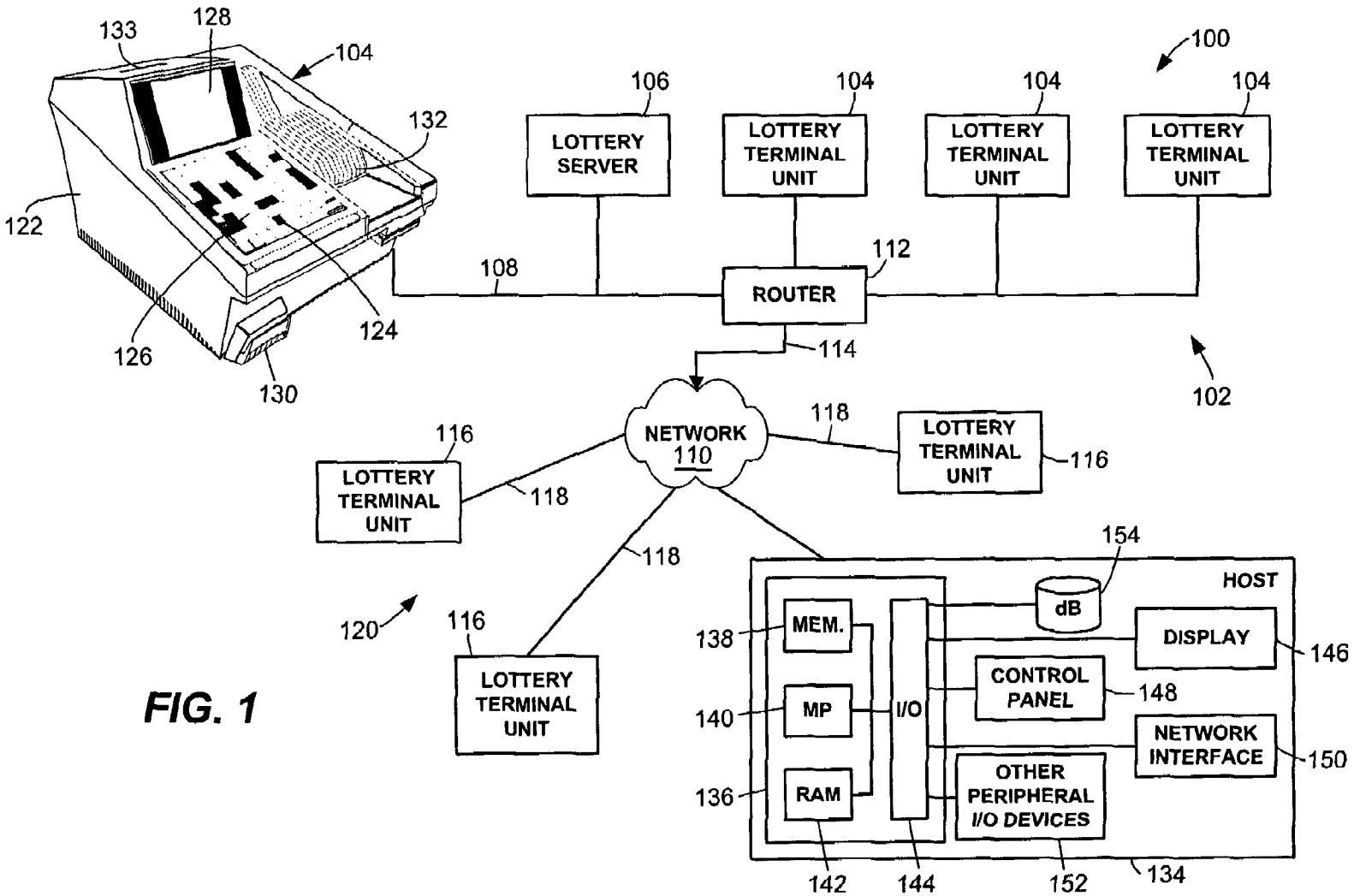
FIG. 1 is a block diagram of an embodiment of a networked lottery system.

FIG. 1 illustrates one possible embodiment of a lottery network 100 that may implement a device and method for implementing a lottery-type game. Referring to FIG. 1, the lottery network 100 may include a first group or network 102 of lottery terminal units 104 operatively coupled to a lottery network computer or server 106 via a network data link or bus 108. The lottery network 100 may be coupled to a network 110, which may be, for example, the Internet, a wide area network (WAN), or a local area network (LAN) through a network hub or router 112 via a first network link 114. In one possible configuration, the first network 102 may be a state lottery system operating within an individual state or region of states. In this configuration, the individual lottery terminal units 104 may be interconnected to a central system for tracking and coordination of the state lottery system, including issued tickets, drawn numbers, and/or amounts waged.

The lottery network 100 may further include other lottery terminal units 116 that may be directly connected to the network 110 through a plurality of direct network links 118, thereby eliminating the need for the bus 108, router 112 or other networking equipment. Each lottery terminal unit 116 in this configuration may represent a group of lottery retailers participating in the state lottery, as described above, or a plurality of the lottery terminal units 116 may be grouped together to form a lottery node 120. The lottery nodes 120, in turn, may be directly connected and/or multiplexed to the network 110 via the direct network links 118. Further, the direct network links 118 may represent secure communications channels physically hardened against tampering and/or the communications may be encrypted to prevent unauthorized access to information transmitted thereon.

FIG. 1 further illustrates a perspective view of one possible embodiment of a lottery terminal unit 104. Although the following description relates to the design of the lottery terminal unit 104 depicted in FIG. 1, it should be understood that the lottery terminal units 104 and 116 may include similar features or may be configured with functionality to allow a user to enter the information required to participate in a lottery game. The exemplary lottery terminal unit 104 may include a housing or casing 122, and one or more input devices, which may be, among other things, a control panel 124 having a plurality of input keys 126, a display 128, a value input device such as a card reader 130, a lottery play slip or ticket reader 132, and a lottery play ticket printer 133, see FIGS. 3 and 3A for an exemplary lottery play slip and lottery ticket. The lottery play slip reader 132 may be configured to read bar codes, user selections, magnetically stored information or any other desired input information. The input keys 126 may allow the player or sales person to select the game to be played, input the value to be wagered, manually enter the selected lottery characters, and input any other information necessary to play a given lottery game. The display 128 may be a LCD, a CRT, a touch-screen capable of receiving and displaying information, or any other suitable device capable of displaying the information input via the input keys 126, the lottery play slip reader 132 or the touch-screen input. The value input device may include any device that can accept value or a wager from a customer, such as the card reader 130 or an optical currency collector. The value input device may further be integrated with external devices, such as cash registers or other retail terminals, communicatively connected to the lottery terminal unit 104, to exchange information necessary to receive and record the wagering transactions. The lottery ticket printer 133 may be used to print or otherwise encode lottery tickets with information selected or required to play a given lottery game. Further, the lottery printer 133 may provide lottery tickets, or even completed lottery slips if the selections were generated automatically, that could be used by the player in other lottery terminal units 116 equipped with lottery play slip or ticker readers 132.

Moreover, the lottery terminal units 104, 116 and lottery nodes 120 may include centralized or shared display mechanisms such as a scrolling digital signs or messaged boards configured to display the outcome of a completed lottery game, and advertisements or attract players to upcoming games. In one exemplary configuration, at least one lottery terminal unit 104, 116 includes software for generating graphics and is communicatively connected to an external LCD suitable for displaying graphics. Upon completion of a lottery drawing, the results or winning information can be formatted by the graphical software and displayed, in an eye-catching manner, on the external LCD. Alternatively, the graphical software may be stored on a peripheral device, such as a CD-ROM, and the result of the lottery drawing communicated thereto for formatting and display.

The network 110, and hence the individual lottery terminal units 104, 116, may be communicatively connected to a central host 134. The central host 134 may be a single networked computer, or a series of interconnected computers having access to the network 110 via a gateway or other known networking system. Generally, the central host 134 may include a central lottery computer 136 configured to manage, execute and control the individual lottery elements 104, 116 and 120 and the routines used to play the various lottery games. The central lottery computer 136 may include a memory 138 for storing lottery programs and routines, a microprocessor 140 (MP) for executing the stored programs, a random access memory 142 (RAM) and an input/output bus 144 (I/O). The memory 138, microprocessor 140, RAM 142 and the I/O bus 144 may be multiplexed together via a common bus, as shown, or may each be directly connected via dedicated communications lines, depending on the needs of the lottery system.

Further, the central lottery computer 136 may be directly connected or hardwired or indirectly connected through the I/O bus 144 to external components such as a display 146, a control panel 148, a network interface device 150 and other peripherals I/O devices 152. Examples of other peripherals device include, but are not limited to, storage devices, wireless adaptors, printers etc. In addition, a database 154 may be communicatively connected to the central lottery computer 136 and provide a data repository for the storage and correlation of information gathered from the individual lottery terminal units 104, 116 or lottery nodes 120. The information stored within the database 154 may be information relating to individual lottery terminal units 104, 116 such as terminal specific information like the machine ID, sales agent, and location the location of each lottery ticket printed. The database 154 may further include ticket specific information such as the type of game played (Lotto, Pick-3, Pick-4 etc.) or game specific information such as the total lottery sales; the drawing outcomes, amounts wagered and numbers selected.

In operation, the central lottery computer 136 may operate as a clearing-house for the lottery terminal units 116 and the first lottery network 102, whereby the lottery network computer 106 collects, stores and analyzes status and operational information relating to each lottery terminal unit 104. For example, the lottery network computer 106 may continuously receive transactional data from the individual lottery terminal unit 104 indicative of the number of tickets sold and associated dollar amounts, and the lottery numbers and number order generated at each lottery terminal unit. The transactional data collected by the lottery network computer 106 may be communicated to the central host 134 continuously or may be processed into a batch format and transmitted periodically for storage in the database 154. If, for example, the central lottery computer 136 and the lottery network computer 106 are communicating continuously, it may be desirable for the central lottery computer 136 to execute the actual lottery routine and transmit the results to the lottery network computer 106 for distribution to the lottery terminal units 104 and directly to the lottery terminal units 116. In addition, it may be desirable for the central lottery computer 136 to include, via the peripheral device input 152, a scanner, such as the lottery play slip reader 132, for directly importing/reading manual selections into the database 154.

It will be understood that the lottery network 100 illustrated in FIG. 1 may alternatively represent the network layout of a gaming establishment providing a lottery-type game. In this alternate configuration, each stand-alone lottery terminal unit 104 may be an interactive player terminal capable of playing a variety of casino games such as a lottery game, keno, bingo, video poker or slots. The lottery terminal units 104 may be distributed throughout a single gaming establishment or casino and connected with a LAN, or throughout multiple casino sites and connected with a WAN. Further, the LAN and/or WAN connecting each of the lottery terminal units 104 may include one or more separate and secure buses 108, routers 112, webservers, gateways and other networking equipment to insure continuous and/or redundant connectivity to the network 110. The network 110, configured in this manner, provides a system for players to collectively participate in a centralized lottery-type game. Further, the network 110 may include express lottery stations at which players may generate predefined or automatically selected lottery tickets simply by making a selection and a wager. As discussed above, the network 110 may be communicatively connected to the central host 134, the central lottery computer 136, and the database 142 to allow for implementation, storage, tracking and analysis of the lottery game.

Lottery Unit

Figure 2:
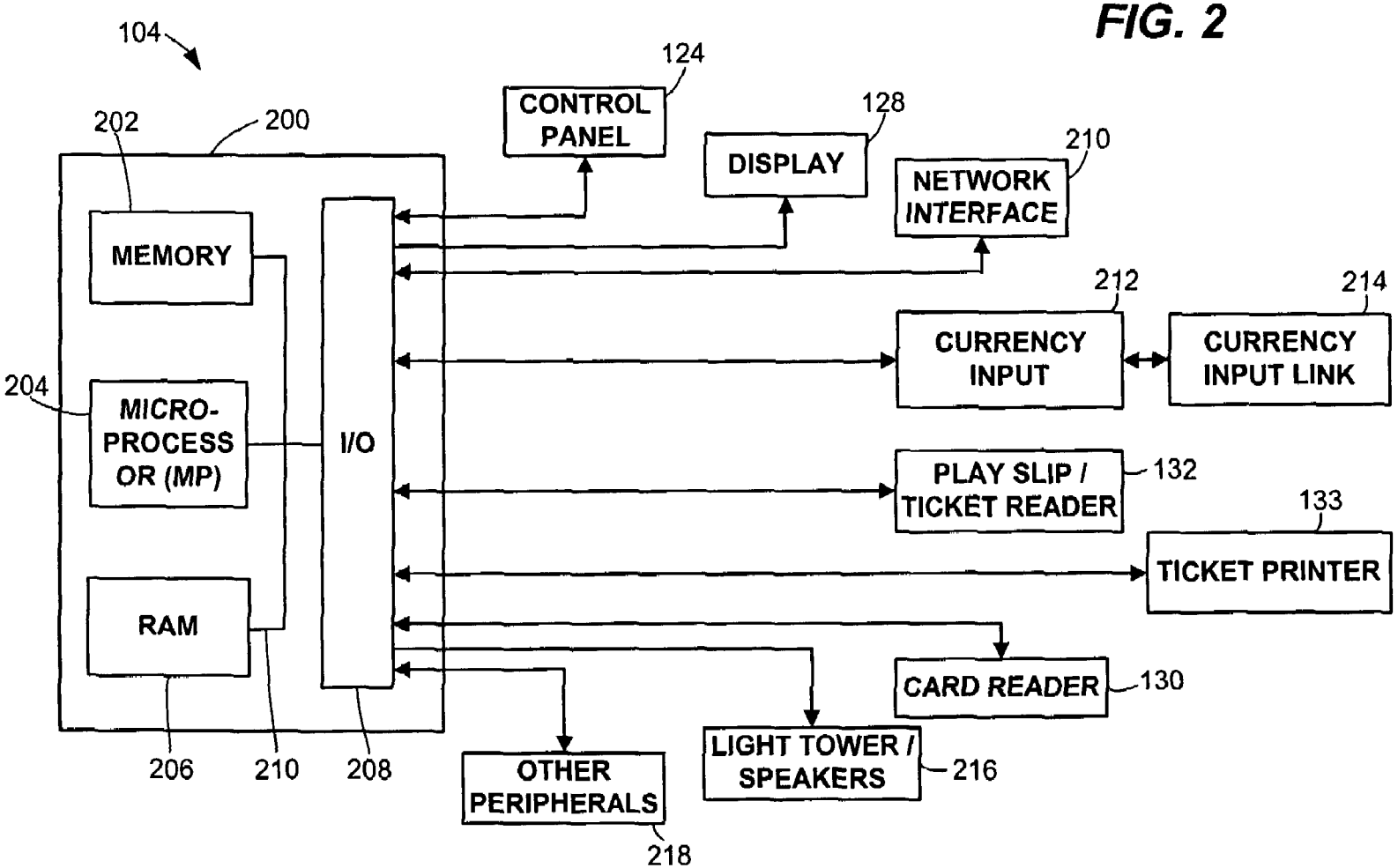
FIG. 2 is a block diagram of the electronic components of the lottery terminal unit shown in FIG. 1.

FIG. 2 illustrates a block diagram of an embodiment of the internal electronic components of the lottery terminal unit 104. The lottery terminal unit 116 may have the same or a different design. Referring to FIG. 2, the exemplary lottery terminal unit 104 may include a number of internal components such as a controller 200 having a program memory 202, a microcontroller or microprocessor (MP) 204, a random access memory (RAM) 206, and an input/output (I/O) bus 208, all of which may be interconnected via an address or data bus 210. It should be understood that although only one microprocessor 204 is shown herein, the controller 200 may be designed to support multiple microprocessors 204 arranged to operate in parallel or in any other known configuration. Similarly, the controller 200 may include multiple, and even redundant, program memory 202 and random access memory 206 to increase expandability, capacity and/or processing speed. The multiple processor and memory configuration, may be used, for example to isolate the individual lottery functions such as basic lottery operation, random number generation, information tracking etc. Although the I/O bus 208 is shown as a single addressable and integral block, it should be understood that direct I/O connections may be made, as well as any other desired I/O connection scheme. The program memory 202 and random access memory 206 may be implemented as a solid-state memory, an integrated circuit, a magnetically readable memory, and/or optically readable memories. Further, the program memory 202 may be read only memory (ROM) or may be read/write memory such as a hard disk. In the event that a hard disk is used as the program memory, the data bus 210 may comprise multiple address/data buses, which may be of differing types, and there may be a separate I/O circuit between the data buses.

FIG. 2 schematically illustrates that the controller 200 may be communicatively connected to the control panel 124, the display 128, the card reader 130, the lottery play slip or ticket reader 132 and the ticket printer 133. The controller 200 may further be communicatively connected to a network interface card (NIC) or device 210, a currency input device 212 including a currency input link 214, and a light and speaker link 216. The network interface card 210 may be configured to allow the lottery terminal unit 104 to communicate information with other networked devices, similarly connected to the network 110, using any known protocol or standard suitable for a lottery or network application. The currency input device 212 may be any kind of value input device discussed above, or may include a currency input link 214 communicatively connected to a cash register (not shown) or other device for tracking and/or totaling currency or transactions. The light and speaker link 214 may be used to integrate visual and/or audio displays into the design of the lottery terminal unit 104.

FIG. 2 illustrates the components 124, 128-132, and 210-218 directly connected to the I/O bus 208 via dedicated circuits or conductors, however it will be understood that different connections schemes may be used. For example, some of the components requiring limited communications with the controller 200 may be communicated via an auxiliary I/O bus (not shown) in a scheduled manner, while other components requiring fast communications or large data transfers may be directly connected to the I/O bus 208. Furthermore, depending on the needs of the system, some of the components may be directly connected to the microprocessor 184 without having to pass through the I/O bus 208.

Lottery Ticket

Figure 3A:
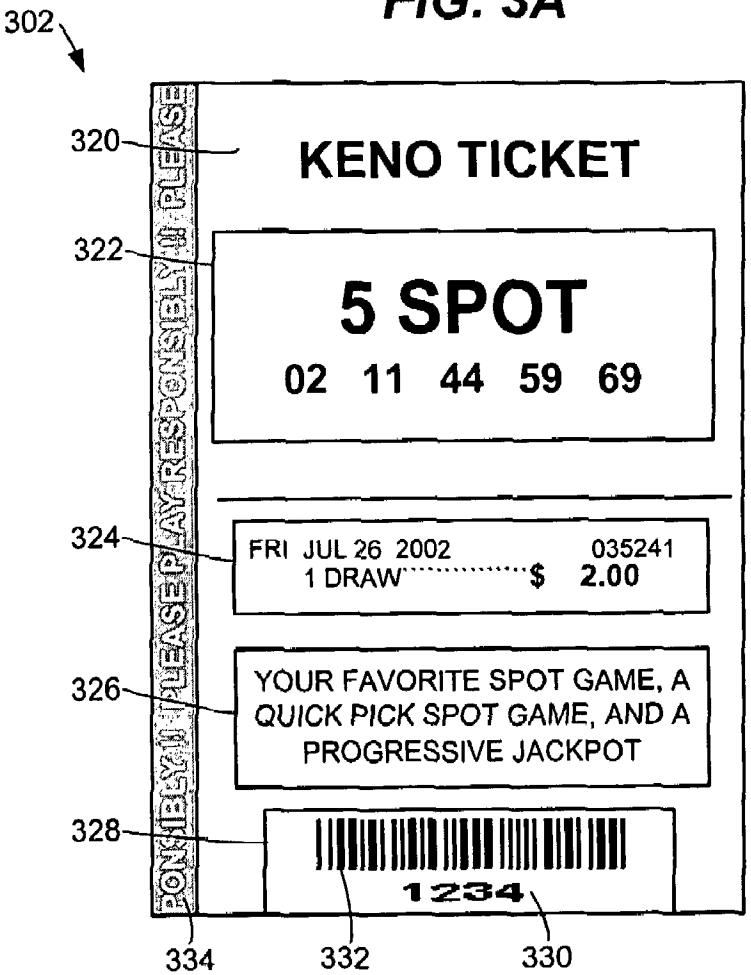
FIG. 3A illustrates an embodiment of a lottery ticket that may be generated in response to the lottery slip of FIG. 3.
Figure 3:
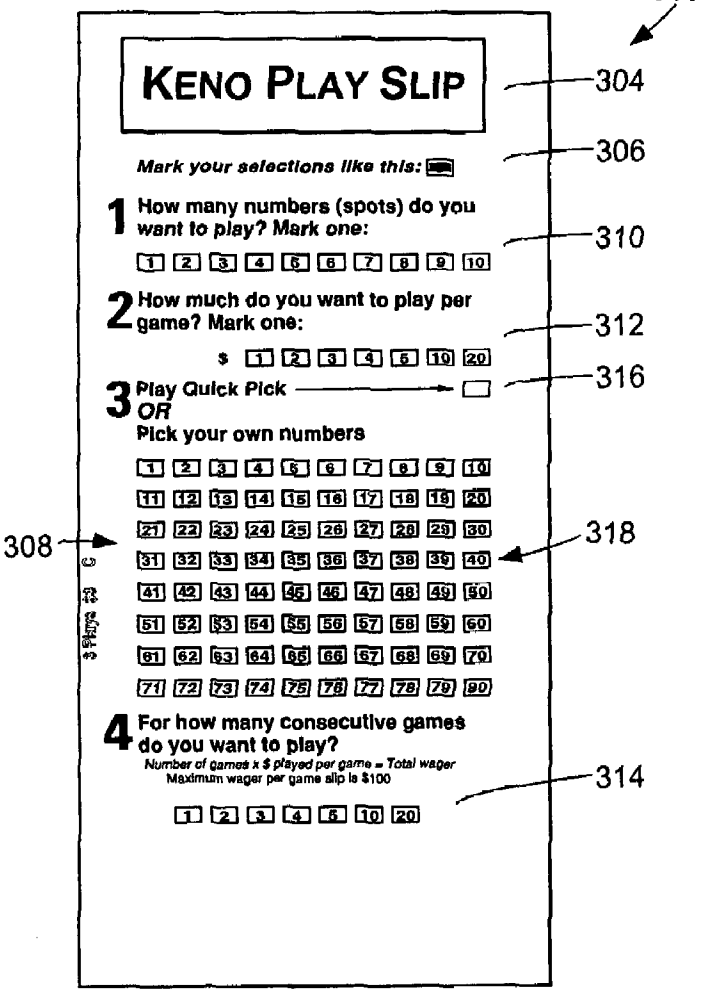
FIG. 3 illustrates an embodiment of a lottery play slip.

Regardless of the configuration or layout of the lottery system 100, it will often be the case that the lottery terminal unit 104, 116 will include lottery play slip or ticket readers 132 which may be used to scan an instant game ticket or a lottery slip 300 completed by the player, and a lottery ticket 302 previously generated at a lottery ticket printer 133, to determine whether the ticket contains a winning combination. Referring to FIGS. 3 and 3A, the lottery play slip 300 and the lottery ticket 302 may be composed of paper, mylar, cardboard or any other suitable printable or encodable material. The lottery play slip 300 and ticket 302 may include informational, instructional or security information such as a bar code, award details, authentication numbers, or any other desired information. Further, it will be understood that different ticket types and formats may be used depending on the theme, format and rules of the game. The lottery ticket 302 may be printed with any optically readable material such as ink, or encoded with data on a magnetic material or other smart chip.

Referring to FIG. 3, the lottery play slip 300 can be configured and arranged in any number of variations for use in lottery games such as keno, lotto, Pick-3 and Pick-4 games, but may typically include a number of common indicia or information. For example, the exemplary lottery play slip 300 may include a title 304 indicative of the associated game, a set of directions or instructions 306, and a plurality of game specific selections, as generally indicated by the numeral 308. The game specific selections may allow the player to define how many numbers to play 310, the exact amount to be wagered 312, and the number of games or rounds to be played 314. Further, the lottery play slip 300 may be arranged to allow a player to make a Quick Pick 316 (e.g. accept a selection that is automatically and randomly selected by one of the lottery terminal units 104, 116 or the central lottery computer 136), or a manual selection area 318 arranged to allow the player to select from a predefined list of numbers, letters or characters. In this manner, the player or a sales agent can fill-out, code or otherwise record the information necessary to participate in a specific game of chance, and provide that information to a central collection point, such as the lottery terminal unit 104, 116 or the central lottery computer 136 for processing and/or recordation.

The exemplary lottery play slip 300 illustrated in FIG. 3 is configured to play a keno game as indicated by the title 300. The player may select how many numbers or spots are to be matched in a given keno game at 310, thereby decreasing the odds of winning and simultaneously increasing the potential payout of a winning selection. By selecting a Quick Pick 316, the player may allow the lottery terminal unit 104 to randomly select a plurality of numbers equal to the number of spots indicated at 310. However, the player may opt to manually select the numbers by choosing numbers (i.e. spots) between 1 and 80, as indicated in the manual selection area 318. Finally, the manual or automatic selections may be consecutively played by indicating the desired number of games, for example one, two, three, four, five, ten or twenty, at 314.

FIG. 3A details the exemplary lottery ticket 302 that may be generated in response to the selections made by the player on the lottery slip 300. For example, the lottery ticket 302 may include a title 320 indicative of the game being played, a game area 322 that may provide results, confirmation information or other game-related information, and a status area 324 that may include wager information, drawing date, tracking information etc. Further, the lottery ticket 302 may include an advertising area 326 where messages or other consumer information may be printed, and a coding area 328 that may have a tracking number 330 and a graphical code 332. The tracking # 330 and graphical code 332 may be used to confirm the validity of the ticket, the location of purchase, amount of wager, numbers selected or any other desired information. The lottery ticket stock, or blank, may be preprinted with additional information such as, a public service message 334, a disclaimer, game rules or any other desired end-user license or contract information.

The exemplary lottery ticket 302 illustrated in FIG. 3A is configured to display the results of a keno game as indicated by the title 320. The user selected numbers or spots may be displayed in the game area 322 providing confirmation to manual or automatic selections made on the lottery play slip 300 or at the lottery terminal unit 104. Alternatively, the selected spots and the chosen winning spots may be displayed in the game area 322, depending on the rules and format of the keno games being played. The status area 324 may contain information such as the amount wagered on each keno game, the number of consecutive keno games to be played and the date and time on which the keno drawing is to occur. Promotional or other related advertising information may be displayed in the advertising area 326 to encourage players to replay this keno game or other related games.

It will be understood that to play the exemplary keno game described above, the player may manually fill-out the lottery play slip 300 using a pencil, pen or other input method, key-in the desired selections at the lottery terminal unit 104, or instruct a sales agent to key-in the desired selections. The completed lottery play slip 300 may be printed by the ticket printer 133 of the lottery terminal unit 104 as confirmation, and read by the lottery play slip reader 132 of the lottery terminal unit 116. If, for the sake of example, the lottery play slip 300 was completed manually using a pencil, the lottery play slip reader 132 may be used to directly import and confirm the data selected by the player. The selected data may then be used by the lottery terminal unit 104, the lottery server 106, and the central host 134 to generate the lottery ticket 302. At this point, the player may pay for the wager and games being played and a receipt may be generated confirming the transaction.

Lottery Routine

Lotteries are generally implemented as the networked games described above, or as an instant game. Networked lotteries games, such as Lotto and Powerball, are typically communicatively connected through the network 110 to the central lottery computer 124, as described above. Lotto and Powerball often offer multi-thousand or multimillion-dollar jackpots, in which 5 or 6 numbers are randomly drawn from a pool of twenty or more possible numbers, and the player(s) who has selected or been assigned matching numbers is the winner. Network lotteries may further be implemented as a number game, in a "Pick 3" or "Pick 4" format, in which a sample of 3 or 4 numbers are drawn from the integers 0 through 9. Number games such as these, in contrast to typical Lotto or Powerball games, are often performed with replacements (e.g. the number 2 could be drawn twice) and may distinguish by order (e.g. 3-4-5 would be a different outcome than 5-4-3).

The instant or "scratch-off" lotteries may be implemented as an artfully decorated piece of cardboard with game characters or indicia concealed by a covering material such as latex. In one embodiment, the player simply scratches off the covering material to reveal whether or not the ticket is a winner. An alternate embodiment requires the player to scratch off and reveal indicia to determine if they have won. For example, the scratch-off ticket may include six covered indicia, and the player must find three instances of "$20" to win a twenty-dollar prize. It will be understood that the "scratch" off game may be implemented on a video terminal by presenting a variety of indicia hidden behind selectable images. A video scratch off game would require a player to select an image in an attempt to match indicia hidden thereunder. From the seller's point of view, instant games have many disadvantages, such as the relative expense of production, storage, shipment, and security of the instant game tickets, compared to the cost of networked lottery games. Further, the logistics inherent to an instant game insure there is a "fixed" number of winners, resulting in a loss of interest in the game once the predetermined number has been reached. By contrast, a networked lottery game may generate more player excitement, and participation, because of the unlimited and independent number of outcomes available during the course of each game.

Figure 4:
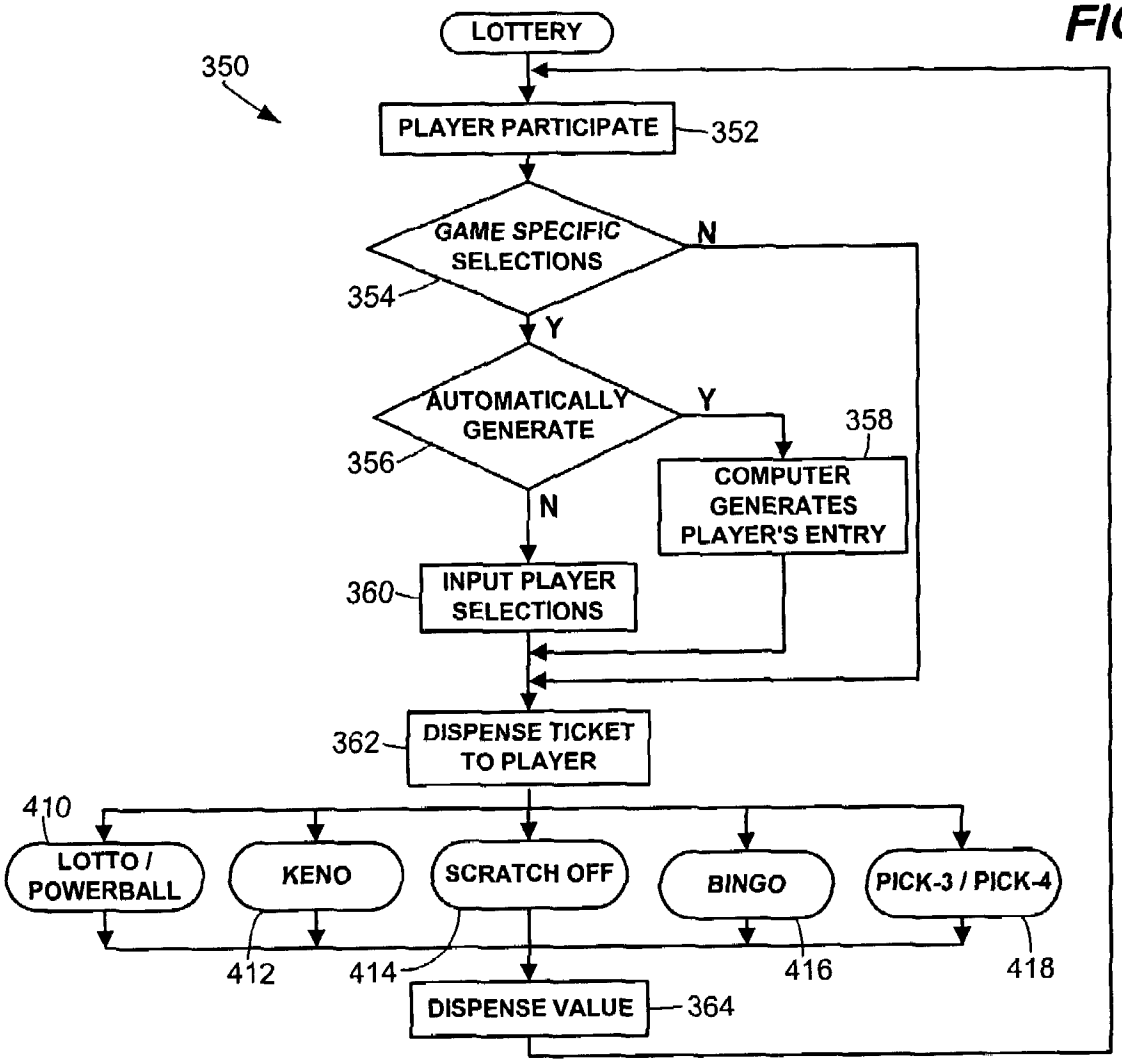
FIG. 4 is a flowchart of an embodiment of a main routine that may be performed during operation of one or more of the lottery terminal units of FIG. 1.

FIG. 4 is a flowchart outlining the flow of a typical manual lottery routine 350 in which a player may participate. Referring to FIG. 4, the manual lottery routine may begin at block 352 with a player deciding to participate in the lottery game. At block 354 the player may make a variety of game specific selections such as type of game to play, the amount to wager, and number of times to play. If, however, the player decides to play predefined games, e.g. a scratch-off game, a ticket may simply be dispensed, as indicated at block 362. At block 356 the player may elect to automatically generate or manually select characters or indicia to be played. If the player elects to automatically generate a ticket, the processor 140 or 204, at block 358, may randomly generate the appropriate number of indicia for game play. If the player elects to manually select characters or indicia, either on a lottery play slip 300 or at the lottery terminal unit 104, they may do so at block 360. Regardless of the manner in which the selections are made, upon completion of the selection process the ticket may be dispensed as indicated at block 362. At this point the player may participate in a variety of the lottery routines, such as a powerball or lotto routine 410, a keno routine 412, a "scratch" off routine 414, a bingo routine 416, and a Pick-3 or Pick-4 routine 418, see FIG. 4. Upon completion of the desired lottery game, the routine may determine the players winnings (or losses) and the amount may be dispensed (or credited against an account etc.) as shown at block 364.

Figure 4A:
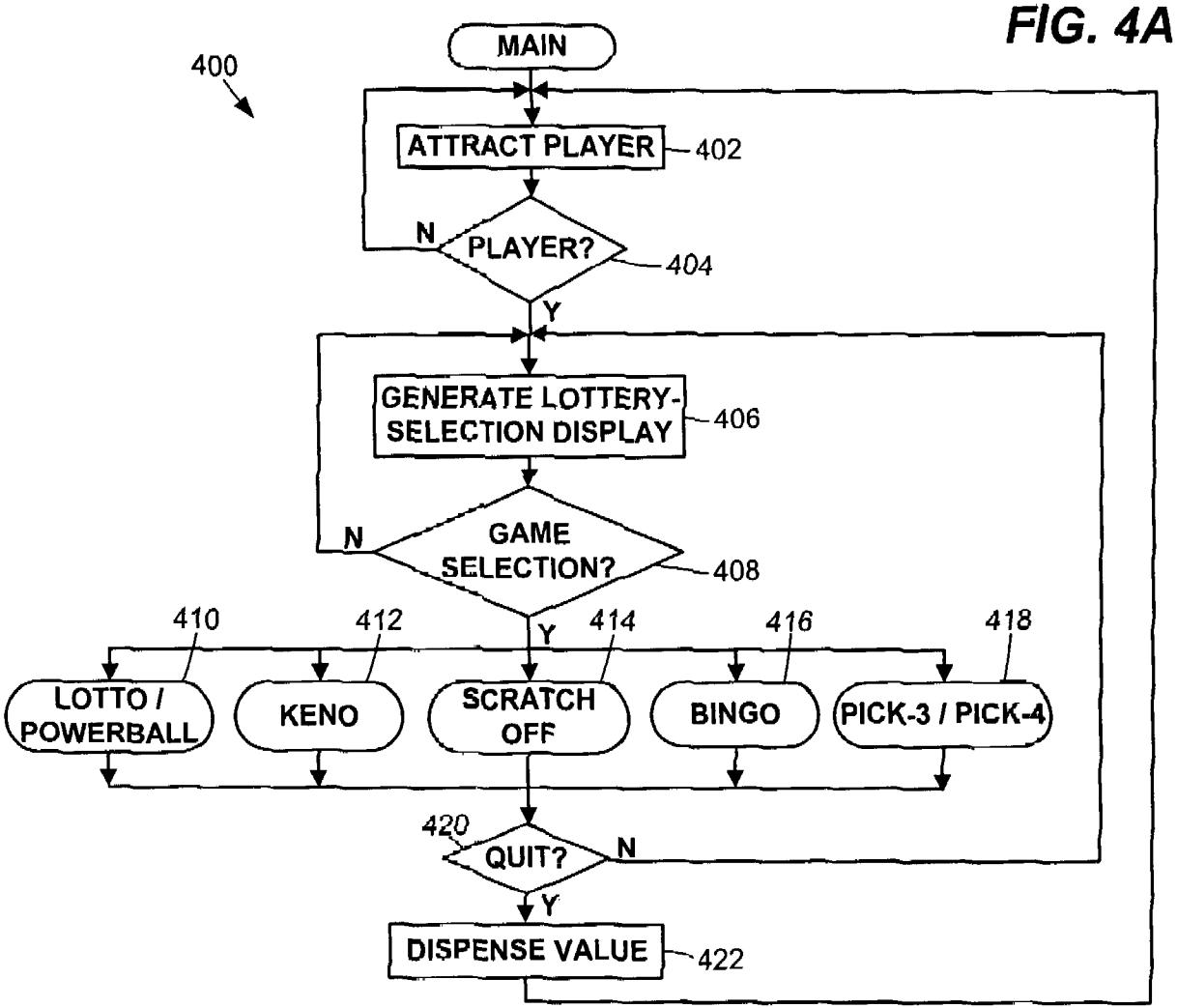
FIG. 4A is a flowchart of an alternate embodiment of an automated lottery routine that may be performed during operation of one or more of the lottery terminal units.

FIG. 4A is a flowchart of an alternate embodiment of an automated main operating routine 400 that may be stored in the memory 202 of the controller 200. Referring to FIG. 4A, the main routine 400 may begin operation at block 402 during which an attraction sequence may be performed in an attempt to induce a potential player to play the lottery terminal unit 104, 116. The attraction sequence 402 may be performed by displaying one or more video images on the display 128 and/or causing one or more sound segments, such as voice or music, to be generated via the speakers 216. The attraction sequence 402 may include a scrolling list of games that may be played on the lottery terminal unit 104, 116 and/or images of various lottery games being played, such as lotto, powerball, keno, "scratch off", bingo or Pick-3 and 4, etc.

During performance of the attraction sequence, if a potential player makes any input to the gaming unit 104 as determined at block 404, the attraction sequence may be terminated and a game-selection display may be generated on the display 128 at block 406 to allow the player to select a lottery available on the lottery terminal unit 104. The lottery terminal unit 104 may detect an input at block 404 in various ways. For example, the lottery terminal unit 104 could detect if the player presses any button on the control panel 124; the lottery terminal unit 104 could determine if the player deposited a smart card into the card reader 130; etc.

The game-selection display generated at block 406 may include, for example, a list of video games that may be played on the lottery terminal unit 104 and/or a visual message to prompt the player to deposit value into the lottery terminal unit 104. While the game-selection display is generated, the lottery terminal unit 104 may wait for the player to make a game selection. Upon selection of one of the games by the player as determined at block 408, the controller 200 may cause one of a number of lottery routines to be performed to allow the selected lottery to be played. For example, the lottery routines could include a powerball or lotto routine 410, a keno routine 412, a "scratch" off routine 414, a bingo routine 416, and a Pick-3/4 routine 418. At block 408, if no game selection is made within a given period of time, the operation may branch back to block 402.

After one of the routines 410, 412, 414, 416, 418 has been performed to allow the player to play one of the games, block 420 may be utilized to determine whether the player wishes to terminate play on the lottery terminal unit 104 or to select another game. If the player wishes to stop playing the lottery terminal unit 104, which wish may be expressed, for example, by selecting a "Cash Out" or equivalent button, the controller 200 may dispense value to the player at block 422 based on the outcome of the game(s) played by the player. The operation may then return to block 402. If the player did not wish to quit as determined at block 420, the routine may return to block 406 where the game-selection display may again be generated to allow the player to select another game.

It should be understood that although five gaming routines are shown in FIG. 4A, a different number of routines could be included to allow play of a different number of games, such as a lottery game or a word-based game. The lottery terminal unit 104 may also be programmed to allow a player to play of different games.

Figure 4B:
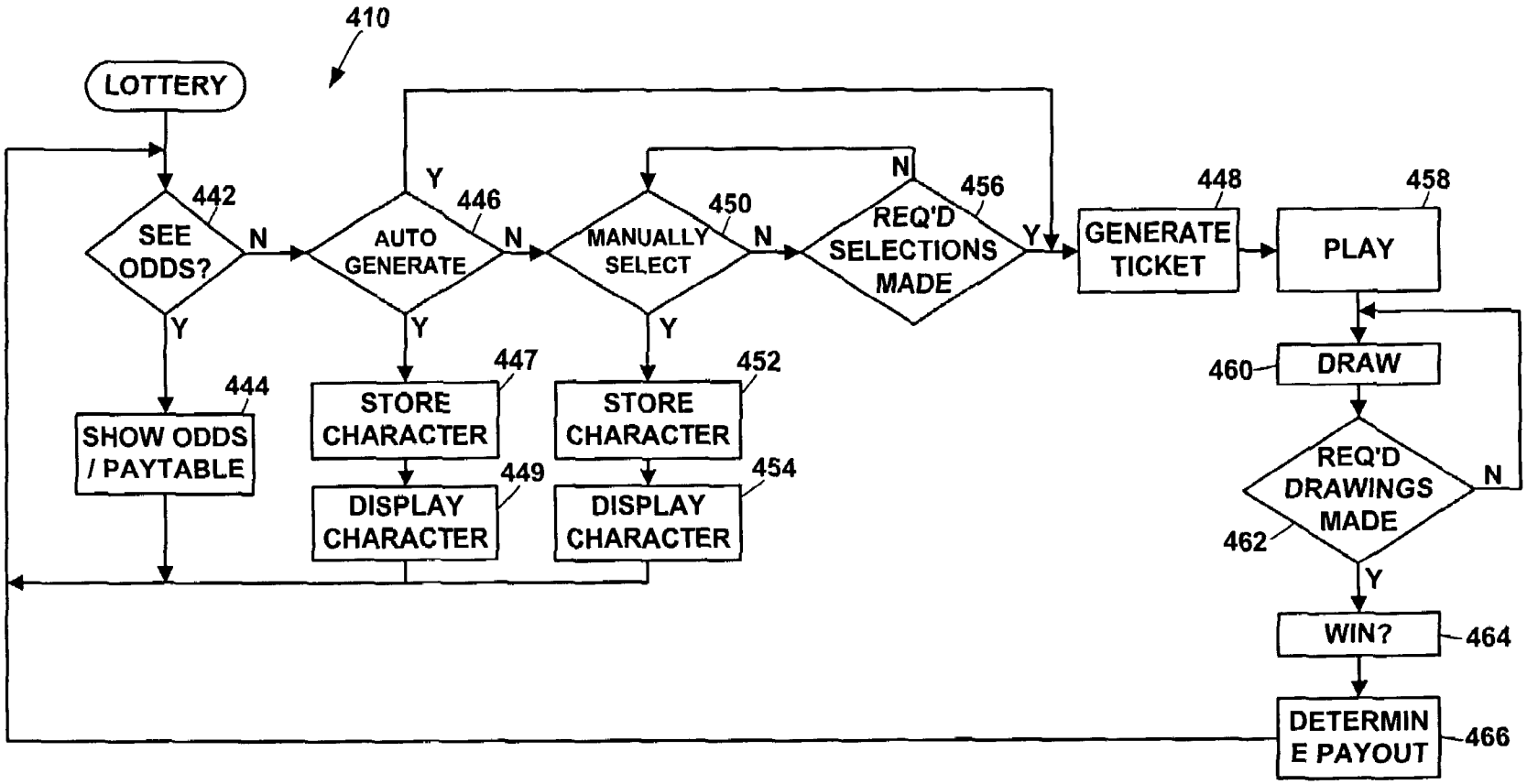
FIG. 4B is a flowchart of a further embodiment of a lottery routine that may be performed during operation of one or more of the lottery terminal units.

FIG. 4B is an alternate embodiment of the lottery routine 400, shown schematically in FIG. 4, generally identified by the numeral 410. Referring to FIG. 4B, the alternate lottery routine 410 may, at block 442, determine whether the player has requested payout or odds information, which may be referred to as "See Odds." At block 444 the routine may cause the lottery odds and payout tables to be displayed on the lottery terminal display 128 or the display 146. At block 446, the routine may determine whether the player elected to have a lottery ticket automatically generated, in which case at block 448 a lottery ticket consisting of a predetermined number of random alphanumeric characters, such as letters numbers, symbols or any combination thereof, may be generated. Further, after the selection has been randomly generated, the results may be stored at 447 in the local RAM 206 or in the central host RAM 142, and displayed at 449 to the user on the lottery terminal unit display 128. At block 450, the routine may prompt the player to select at least one alphanumeric character to be used in the lottery and store 452 the selected character in the random access memory 206, 142 depending on the lottery system 100 configuration. In addition, as shown in block 454, the selected alphanumeric may be displayed graphically on the display 128 or a lottery terminal unit display 128.

At block 456, the routine may determine if the player has made the required number of selections, the required number of selections may vary based on the lottery game being play. For example, a "Pick 4" game may require a player to select four alphanumeric characters from a predefined group of between one and thirty-six. If the player has made the required number of selections (e.g. picked four numbers) the routine may generate a confirmation ticket, as shown in block 448. If, however, the player has not selected the required number of characters, the routine may prompt the user to make additional selections.

At block 458, the routine may determine that the required game conditions have been met, and may initiate a lottery game sequence. The lottery game sequence may simply be the random selection of the character, as shown in block 460, or may include a visual/graphical display designed to inform and/or excite the player. At block 462 the routine may determine if the required number of random characters has been selected based on the lottery game being played. If additional selections are required the lottery routine loops, as is schematically shown, until the required number of selections has been made.

At block 464, the lottery routine may determine whether the randomly selected characters coincide with the player's selection and constitute a winning selection. That determination may be made by comparing data representing the currently displayed selection with data representing the player's section stored in the memory of the controller 138, as shown in block 452. If the selections constitute a win, a payout value corresponding to the number of corresponding selections, the order in which the selections were made, and/or any other win criteria, may be determined, as shown in block 466.

Although the lottery routine 410 is described above in connection with a single lottery game, the routine 410 may be modified to allow other versions of the lottery to be played. For example, an interactive game may be played where the user randomly selects the numbers to be selected from a predefined group of symbols representing possible alphanumeric choices. The interactive game may be presented in the display 128 of the lottery unit 104, as a main game, or as a bonus game accessible through the play of a main game.

Word Based Lottery Ticket

Another embodiment of a lottery game may generally be implemented by assigning prize values to words. The words may be a list, a phrase, a sentence, a paragraph or any other coherent text. Winning entries may be determined by matching in some manner a sample of letters to the letters comprising a word, the sample being the product of a random process and independent of the particular words used in the game.

Figure 3B:
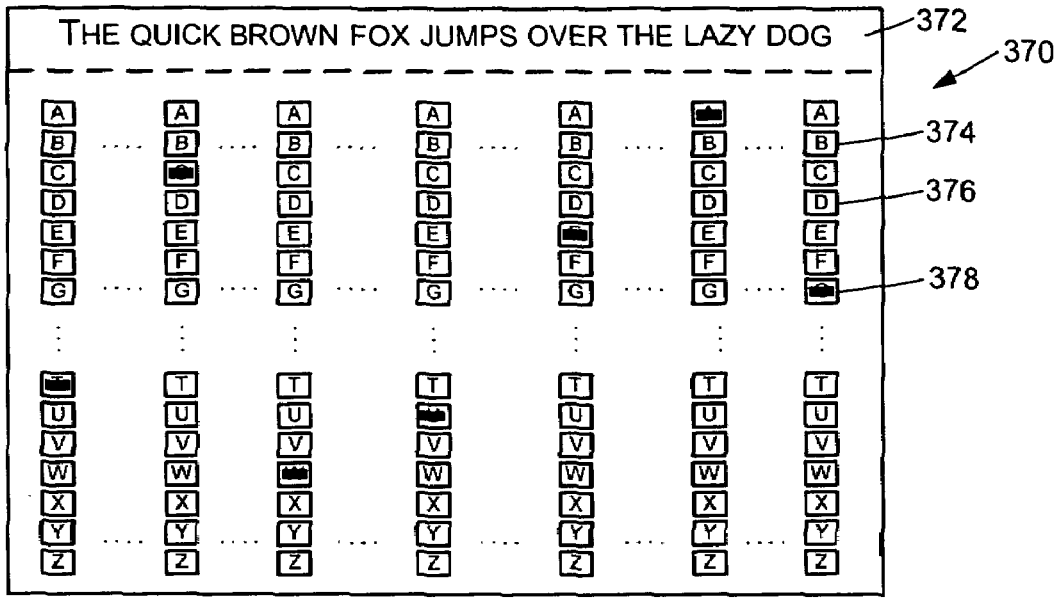
FIG. 3B illustrates an alternate embodiment of the lottery play slip illustrated in FIG. 3.

FIG. 3B illustrates an exemplary word based lottery play slip 370 similar to the lottery play slip 300 described in FIG. 3. The word based lottery play slip 370 may include many of the general components described in connection with the lottery play slip 300, these components may be, among other things, the title 304, directions 306, general game selections 308, wager 312, number of games 314, quick pick 316, and manual selection area 318. The word based lottery play slip 370 may further include a section by which a player can manually select a phrase. The manual selection area 318 may allow the player to code the word or play phrase 372 by filling in an indicator bubble 374 corresponding to an indicated letter 376. For example, the player may choose the play phrase 372 "The Quick Brown Fox Jumps Over the Lazy Dog" which, in turn, my be coded as described above. In other words, the player may write the desired word or play phrase 372 along the top of the play slip 370, and then fill in the indicator bubbles 374 to create a machine-readable format. The indicator bubble 374 may be filled in by a selection mark 378 that may be a No. 2 pencil mark, ink, or any other magnetically, or optically readable sign.

The coded word based lottery play slip 370 may, in turn, be imported into the lottery terminal unit 104 via the lottery play slip reader 132. In this way, the play phrase may be translated into a computer readable format and stored locally in the memory 202 or RAM 206 depending on the configuration of the lottery system. Alternatively, the information may be communicated to the lottery server 106 and/or directly transmitted through the network 110 to the central lottery host 134. The central lottery host 134 may, in turn, store the information in the memory 138, the RAM 142 and the database 154.

Figure 3C:
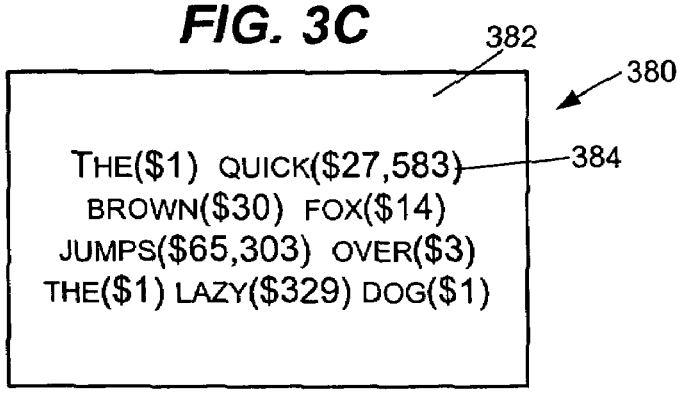
FIG. 3C illustrates an alternate embodiment of the lottery ticket that may be generated in response to the lottery slip of FIG. 3B.
Figure 3D:
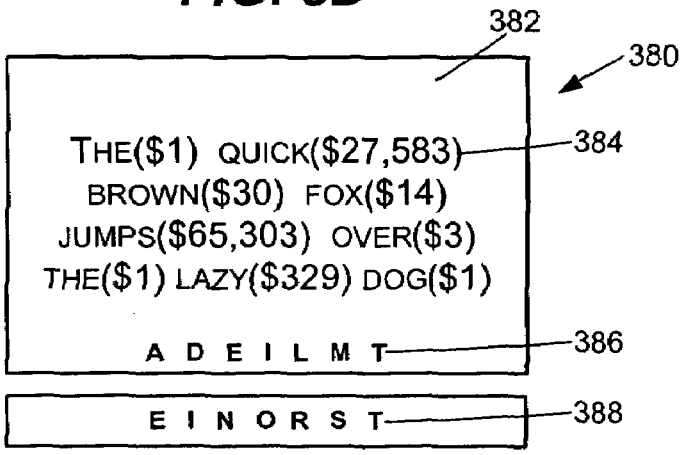
FIG. 3D illustrates another embodiment of the lottery ticket that may be generated in response to the lottery slip of FIG. 3B.

In the alternative, the word lottery may be implemented as either a quick-pick or "scratch off" game, as illustrated in FIG. 3D. Automatic selections may be printed on a quick-pick, preprinted on cards, displayed on a monitor or screen, or listed in any other player accessible medium. A "scratch off" word based lottery game may arrange the word based lottery ticket 380 to include a preprinted play phrase 372 and a plurality of covered selections representing an randomly generated, independent alphabetic sequence. The player may "scratch off" or remove the covering to see the character string and if the words in the phrase match the character string, the player wins the prize associated with that word.

In another alternative, a quick-pick or scratch off has a play phrase 372 with prizes on it but does not have a character string 386 printed on it. The player can have his quick-pick or scratch off scanned to produce a separate ticket that contains the character string 386 which can be selected randomly and independently of the play phrase 372 on the quick-pick or scratch off. That is, the character string 386 does not "know" the contents of the quick-pick or scratch off. If one or more words in the phrase match the character string 386, the player wins the prize associated with those words.

In yet another alternative, the player may customize the lottery ticket 380 at a player-activated terminal 104, 116. The player may be able to create the play phase 372 and adjust, within some predefined constraints, the way prizes are assigned to the phrase. The word lottery ticket 380 can be produced including the customized or desired phrase 372 and the associated prizes. The resulting word lottery ticket 380 can then be scanned by the retailer to produce a second ticket with a character string 386. If one or more words in the play phrase 372 match the character string 386, the player wins the prize associated with those words.

Regardless of the manner in which the play phrase 372 is defined or the general way in which the optional word based lottery play slip 370 is configured, a word lottery ticket 380 memorializing the desired play phrase 372 may be printed by the ticket printer 133 integral to the lottery terminal unit 104.

Generally, the word based lottery ticket 380 may include the same general components described in connection with the lottery play ticket 302, these components specifically may include, among other things, the title 320, game area 322, status area 324, advertising area 326, coding area 328 including the tracking number 330 and graphical code 332.

Referring specifically to the components indicated in FIG. 3C, the word lottery ticket 380 may provide a confirmation phrase 382 corresponding to the play phrase 372 coded on the optional word based lottery play slip 370. A prize amount 384, corresponding to the potential winning value assigned to a given word or letter grouping, may be displayed to provide information to the player or to build player excitement and enjoyment. The play phrase 372 with the associated prize amounts 384 may be assigned to the player or the player may select his phrase from a menu of phrases or he may create his own phrase via a play slip or by inputting (e.g. typing) the phrase into a player-activated terminal.

The player may also have some control as to the actual prize amounts 384 on the lottery ticket 380, for example, the player may opt for a higher top prize in which case the prizes amounts 384 can be reconfigured to reflect the higher maximum prize amount 384. It will be understood that this customization does not have to effect the overall expected return to the player. The play phrase 372 and the associated prizes 384 may be placed on the ticket or displayed on some type of electronic display unit such as that on a player-activated terminal. The associated prizes 384 may be identified with individual words in a variety of ways, for example, it may be expressed immediately after the word in parentheses or directly above or below the words. Regardless of the location of the prize amount 384 relative to the play phrase 372, it is important for the association between the two to be clearly evident to the player.

Once the play phrase 372 and the associated prize amounts 384 have been determined, a randomly generated, independent character string 386 can be produced. The character string 386 can be any a sequence of letters that may or may not include repeated letters. The character string 386 can typically be produced in a randomized process independently of the play phrase 372 and the associated prizes. For example, the letters or characters could be placed on balls and drawn from a hopper or blower, either with or without replacement, as are numbers in a lottery game. The letters can be generated by a computer based on any desired frequency or statistical distribution.

The character string 386 is randomly and independently generated with respect to the play phrase 372. It will be understood that generation of the character string 386 can be accomplished in through a variety of processes. However, regardless of the generation process employed each possible outcome can be assigned a probability. This is what allows the assignment of precise prizes. The correlation between the character string 386 and the words in the phrase determines the winners. For example, the game could be defined such that there are no repeats allowed in the character string 386 and each letter can be used as many times as desired. A word is "won" if it can be formed from the letters contained within the character string 386 wherein each letter in the character string 386 can be used as many times as desired.

Another way of playing may be to allow repetition in the character string 386. To match or win a word it is necessary for the letter in the character string 386 to appear at least as many times as in the word. Still another way of playing would be for a word to match or win if it contains all of the characters of the drawn character string 386. Whatever the method by which it is produced, and criteria by which a match or winner is determined, the character string 386 can be imparted to the player in a number of ways. For example, the character string 386 can be placed on the same ticket as the play phrase, or placed onto a separate ticket.

Another way of imparting the character string 386 to the player is to display it on the display 146, 128. The character string 386 would apply to not just one player but to a group of players enrolled in a particular game through the central lottery host 134 or lottery server 106. This particular embodiment has the advantage that it makes it apparent to the player that the character string 386 is indeed independent from his play phrase 372 as the character string 386 applies to multiple players with different phrases.

Still another way to derive the character string 386 is through a daily or biweekly drawing. The character string 386 could be made available to the player at the retailer, via the Internet, or traditional media, such as television or the newspaper.

Another way of imparting the character string 386 would be in the context of an electronic game wherein the play phrase 372 and associated prizes 384 can be displayed on the display 146, 128. After the player has made his wager, the character string 386 can be displayed, and winnings could be dispensed at the machine or in the form of a voucher. It will be understood that character string 386 may be selected or generated by any combination of the above-described methods.

FIG. 3D illustrates the word lottery ticket 380 of FIG. 3C including a character string 386 representative of the randomly selected characters selected during the course the word based lottery game. An alternate character string 388 may be purchased by the player to increase the possibility of matching words or letter groups within the play phrase 372, and incidentally increasing the revenue of the word based lottery game. The character string 386 and the alternate character string 388 may be randomly selected to insure they are independent of the content of the play phrase 372.

Word Based Lottery Routine

As described above, word based lotteries may be implemented with virtually any text or phrase. A random sequence of letters determines the winning word(s). Though the sequence of letters is random it is produced by a definite process by which all possible outcomes can be assigned a probability. That is, though the character string 386 is determined randomly and independently of the text or phrase, the proportion of times that a given word will win can be precisely stated. This predictability allows the gaming establishment or organization to establish prizes commensurate with the amount of money to be returned to the player in the long run.

Figure 4C:
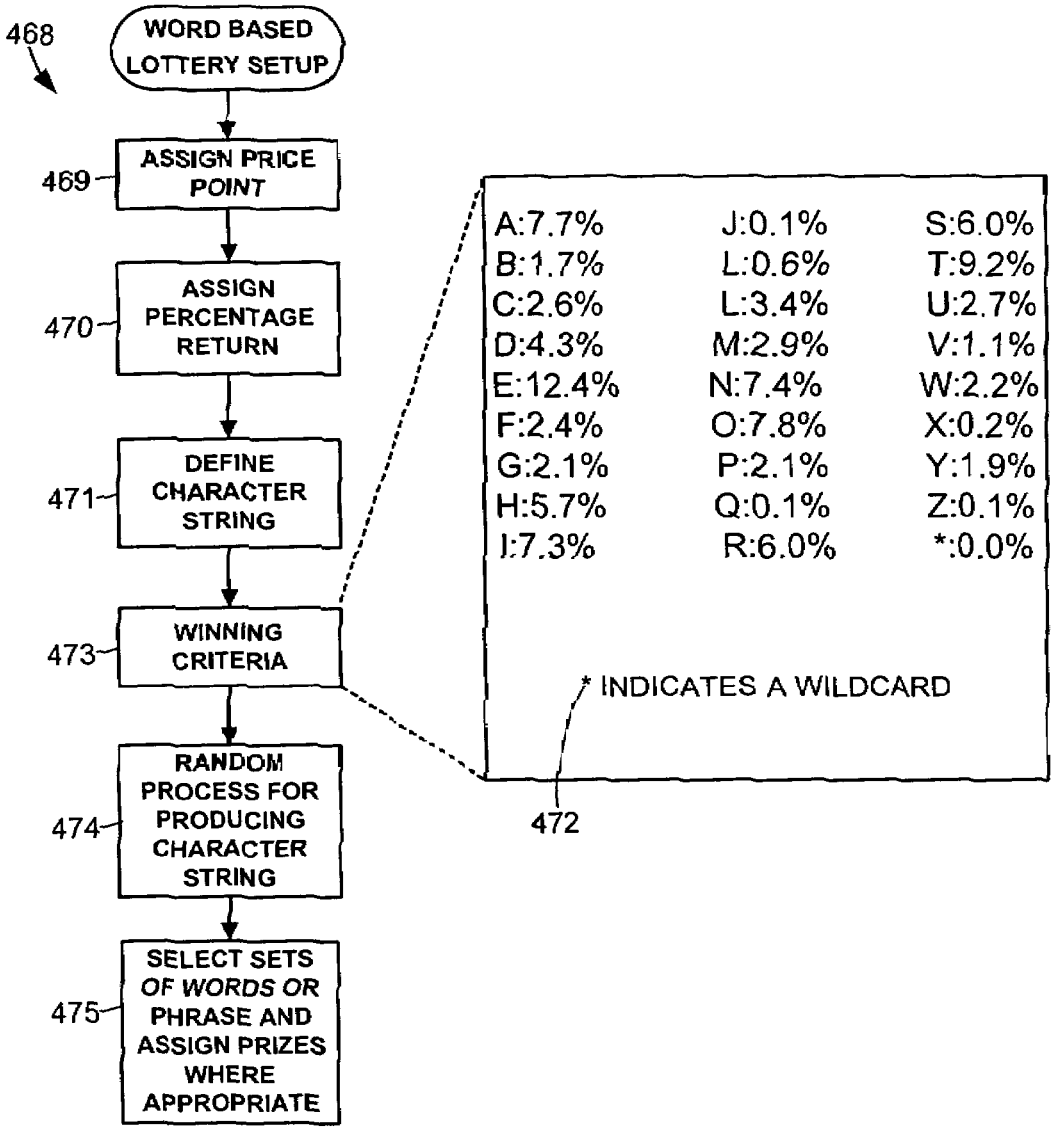
FIG. 4C is a flowchart of a embodiment of a word based lottery setup routine in which a player may participate.

FIG. 4C illustrates a flowchart describing a configuration and setup routine 468 of the exemplary word based lottery game. Referring to FIG. 4C, the setup may begin at block 469 by determining the price point for one round of the word based lottery game. Generally, the price point may be thought of as the cost of an individual ticket or round, for example, a scratch-off ticket may cost a dollar. The percentage return may be assigned or set at block 470. The percentage return is the expected percentage of that which is paid by the player to be returned to the player. For example, a return of 50% means that 50% of that which is paid in by player is returned to players in the long run. At block 471 the parameters of the character string draw are decided. As discussed above, the character string typically determines the winners and should be precisely defined. General rules governing the selection of the character string include the number of letters in the character string, whether or not letters may be repeated, and whether or not wildcards are to be allowed. For instance, a wildcard 472 indicated by a "*" symbol, may be included in the letter distribution and used as a substitute for any other letter in the distribution. At block 473, the winning criteria including the above-mentioned letter distribution may be defined. At block 474, the random and independent process for determining the character string 484 may be defined.

There are various ways to determine the character string. For example, letters defining the character string 386 could be treated like lottery balls and drawn at random (with or without replacement). In this case, common letters may occur in greater frequency, e.g. there could be 10 letter "E" lottery balls for every letter "Z" lottery ball. Alternatively, the character string 384 could also be produced by the letter distribution, as shown at block 473. The letter distribution may assign percentages to different letters in the alphabet. The character string 384 could be computer-generated based on such a distribution. Furthermore, if it is desired that there be no repeated letters in the character string 386, this could be accomplished by discarding character strings 386 with repeats until one occurs that has no repeats.

At block 475 play phrases 372 and prize amounts 384 may be assigned and determined. In one embodiment a player may create a personalized play phrase 372 while in another the play phrase 372 may be assigned. It will be understood that a combination of these assignment methods may be used depending on the needs and goals of the particular game. Predefined play phrases 372 can be, for example, quotes, film titles, fortune cookies, or even a simple list of words fitting a theme. Furthermore, these predefined play phrases 372 can be associated with predefined prize amounts 384 which allows for better quality control and consistency. It may be desirable for all of the phrases to have prize amounts of similar magnitudes or prize values that conform to a certain aesthetic.

In determining the prize values for a set of words or phrases, a computer program with a graphical interface may be employed. Various parameters may be input such as the price and the desired overall return. The text phrase may be entered in a window dedicated to that purpose. Also, there may be settings to scale the prizes "lower" or "higher". That is, prizes can be assigned and reassigned varying magnitudes while preserving the overall return. This is accomplished by redistributing the returns for individual words. For example, the lower the probability of winning a word the higher the prize. To achieve higher top prizes some of the return allotted to the "lower prizes" could be diverted to the least probable words resulting in higher "high prizes" (and lower "low prizes"). Once the parameters have been set, a button such as "assign prizes" would be pressed. At this point, the text and the settings are either rejected or prize values appear in correspondence to individual words. If the prizes are overall "too high" or "too low" the scale can be adjusted and "Assign Prizes" pressed again. It should be noted that there are numerous ways in which the "scaling" can take place, but the underlying idea is the same: the returns are redistributed among the individual words such that the total return is the same. This varies the prize values but preserves the desired overall returns.

Figure 4D:
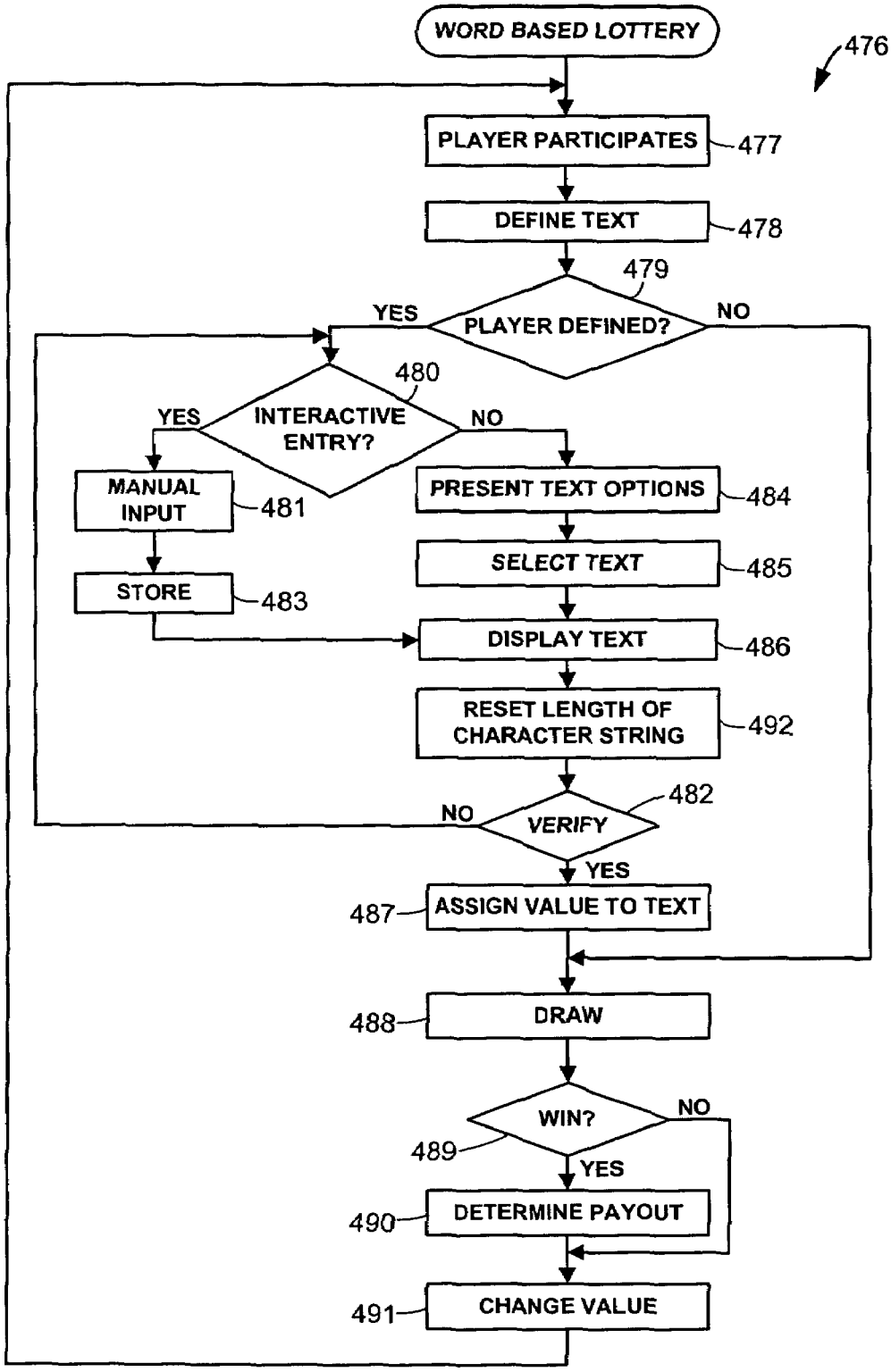
FIG. 4D is a flowchart of a word based lottery game played in accordance with the setup defined in FIG. 4B.

FIG. 4D illustrates an exemplary flow diagram of a word based lottery routine 476 the configuration and setup of which has been generally discussed above in the flowchart 468. Referring to FIG. 4D, the word based lottery game may begin operation at block 477 by the identification and participation of a player. The player may at block 479 elect to define the words or phrase to be played or play a predefined or scratch off version.

If the player decided to define his own words or text he may be prompted or choose, at block 480, to manually or interactively select the words or phrases to be played. If the player decides to manually enter the words to be played, as indicated at block 481, he may begin to manually enter the words into the lottery terminal unit 104 via the control panel 124 and input keys 126, or code the information onto a word based play slip 370. The resulting selection may be stored within the lottery terminal unit 104 in either the static program memory 202 or the RAM 206, as indicated at block 483. Alternatively the selection may be transmitted via the network 100 and/or the lottery network computer 106 to the central host 134 for storage in the memory 138, RAM 142 and/or database 154, depending on the configuration and operation of the lottery network 100.

However, if the player at block 480 chose to interactively select the words or phrases to be played, a predefined list of quotes, phrases, words etc may be presented, as indicated by block 484. The predefined list may be presented in a variety of player accessible formats, such as a graphical list may be displayed on the display 128, preprinted in a phrase book, randomly selected based on trivia or other topics or in any other format organized to arouse the players interest. For example, at block 485, the player may select the predefined quote, phrase, or words to be played from a plurality of choices presented and organized on the display 128 communicatively connected to the lottery terminal unit 104.

It will be understood that regardless of whether the play phrase 372 was manually defined or selected from a predefined list, the chosen play phrase 372 may be displayed, as indicated at block 486, prior to the beginning of game play. The play phrase 372, like the graphical list described above, may be displayed on the lottery terminal display 128, the central host display 146 or any other desired output or announcement device or system.

At block 492 the player may be allowed to reset the length of the character string 384 for some embodiments. In certain embodiments, there is a 1-1 correspondence between the player and the character string 384. That is, in some embodiments a specific character string 384 applies only to one player as opposed to a group of players. The player may desire a character string 384 of a different length. For example, his text might contain unusually long words that could not be won if the character string 384 was too short. At block 482 point, the set of words or phrase is verified to determine if it is viable or not. A set of words may not be viable for a game for a number of reasons. (For example, the probabilities for winning may be too high to support decent prizes.) If a phrase is deemed not viable the player can go back to revise his phrase.

At block 487, the selected or manually entered play phrase 372 may be assigned prize values based on the predefined price point 469, percentage return 470, the definition of the character string 474, the winning criteria 473, and the process for producing the character string. Note, for the "selected phrases" the prizes may or may not have been already assigned, depending on the implementation. The player may have been presented with an interface which may be a part of the lottery terminal unit 104, 116, where he can control parameters such as the length of the alphabetic sequence and the general magnitude of the prizes. There may be maximum values imposed for top prizes, and certain parameters such as the Return would not be available to the player.

Once the set of words or phrase has been established and prize values assigned an character string 386 is produced, the character string 386 being random and independent of the set of words and/or phrase. The character string 386 is what determines which of the words in the set of words or phrase are "winners". There are various ways to do this, the most straightforward being a word is a winner if the word can be formed with letter contained the character string 386, allowing each letter to be used as many times as necessary. For example, the drawn letters E-H-I-O-R-S-T contain O, T, H, E, and R, and if the word "other" in a portion of the play phrase 372 the player receives the associated prize value. In another exemplary embodiment if the word is larger than the drawing size (e.g. greater than seven letters) the player is awarded a prize if all of the drawn letters are contained within the evaluated word. For example, for the drawing containing the letters E-H-I-O-R-S-T, the player would win the prize associated with the word "otherwise" which contains all of the drawn letters.

After each word in the play phrase 372 has been evaluated to determine if it is a winner based on the character string 386, the total payout based on the individual prizes may be determined at block 490. The prize total, in turn, may be updated at 491 to reflect the winnings associated with the now-completed game. If the player did not match any words in the play phrase 372, the prize total may be updated with a zero value. Finally, the player may begin to play another round either by deciding to participate 477 or, if they chose to play multiple rounds during the completion of the word based lottery play slip 370.

It will be understood that the above identified example was intended to be illustrative of the word based lottery concept, and not to limit the concept to a particular form or implementation. Moreover, the basic concept may be executed in any lottery format including, but not limited to, a preprinted scratch off game, a video lottery executed on the lottery terminal unit 116, and in a traditional drawing lottery format such as, for example, lotto, powerball, and Pick-3/Pick-4 formats. For example, the word based lottery concept may be played in Pick-3/Pick-4 format by using short play phrases 372 and conducting a nightly drawing, or in a scratch off format, as discussed above, by producing a preprinted ticket including the play phrase 372, similar to the ticket illustrated in FIG. 3C, and a plurality of covered indicia and letters. The player, in turn, removes the covering to reveal the indicia and determine if a winning selection has been made. Similarly, the lotto, and Powerball games may be implemented by drawing balls or other items from a blower (not shown) to randomly select letters or indicia to be matched against a predefined or player selected play phrase 372. Furthermore, the word based lottery game may be implemented as a monitor game similar to Keno, as described above, or may be played as a bonus, niche or specialty game depending on the needs of the gaming establishment or organization.

Gaming Network

It will be understood that the lottery routine 350, the alternate embodiment of the automated lottery routine 400, and the word based lottery routine 484 may be implemented on the lottery terminal unit 104 as described above, or on a casino gaming unit 504, the configuration and operation of which is described in detail below. For example, the casino gaming unit 504 may be constructed or modified to include a lottery play slip reader 132, a lottery ticket printer 133 or any other necessary equipment or software to communicate with the lottery server 106, the central host 134, and participate in a lottery routine or game. Further, it will be understood that the basic electronic components described in detail in FIG. 6B may be modified, either by the software or hardware, to execute casino games and lottery games depending on the desires of the parties configuring the equipment.

Figure 5:
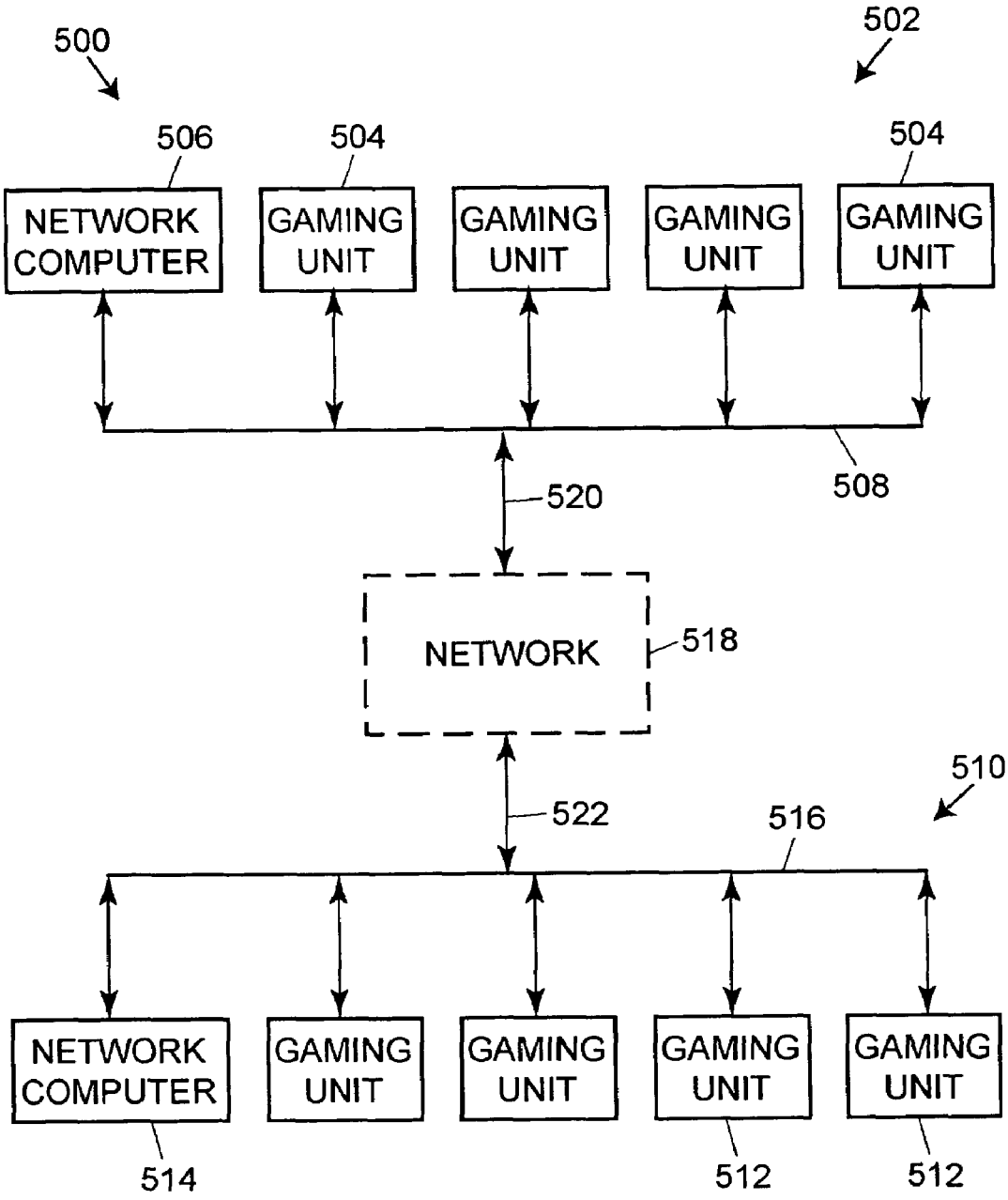
FIG. 5 is a block diagram of an embodiment of a gaming system in accordance with the invention.

FIG. 5 illustrates one possible embodiment of a casino gaming system 500 in accordance with the invention. Referring to FIG. 5, the casino gaming system 500 may include a first group or network 502 of casino gaming units 504 operatively coupled to a network computer 506 via a network data link or bus 508. The casino gaming system 500 may include a second group or network 510 of casino gaming units 512 operatively coupled to a network computer 514 via a network data link or bus 516. The first and second gaming networks 502, 510 may be operatively coupled to each other via a network 518, which may comprise, for example, the Internet, a wide area network (WAN), or a local area network (LAN) via a first network link 520 and a second network link 522. The network 518 may further be a wireless network and include a wireless hub or router communicatively connected to the gaming networks 502, 510 using any known communications standard or protocol.

The first network 502 of gaming units 504 may be provided in a first casino, and the second network 510 of gaming units 512 may be provided in a second casino located in a separate geographic location than the first casino. For example, the two casinos may be located in different areas of the same city, or they may be located in different states. The network 518 may include a plurality of network computers or server computers (not shown), each of which may be operatively interconnected. Where the network 518 comprises the Internet, data communication may take place over the communication links 520, 522 via an Internet communication protocol.

The network computer 506 may be a server computer and may be used to accumulate and analyze data relating to the operation of the gaming units 504. For example, the network computer 506 may continuously receive data from each of the gaming units 504 indicative of the dollar amount and number of wagers being made on each of the gaming units 504, data indicative of how much each of the gaming units 504 is paying out in winnings, data regarding the identity and gaming habits of players playing each of the gaming units 504, etc. The network computer 514 may be a server computer and may be used to perform the same or different functions in relation to the gaming units 512 as the network computer 506 described above.

Although each network 502, 510 is shown to include one network computer 506, 514 and four gaming units 504, 512, it should be understood that different numbers of computers and gaming units may be utilized. For example, the network 502 may include a plurality of network computers 506 and tens or hundreds of gaming units 504, all of which may be interconnected via the data link 508. The data link 508 may be provided as a dedicated hardwired link or a wireless link. Although the data link 508 is shown as a single data link 508, the data link 508 may comprise multiple data links.

Figure 6:
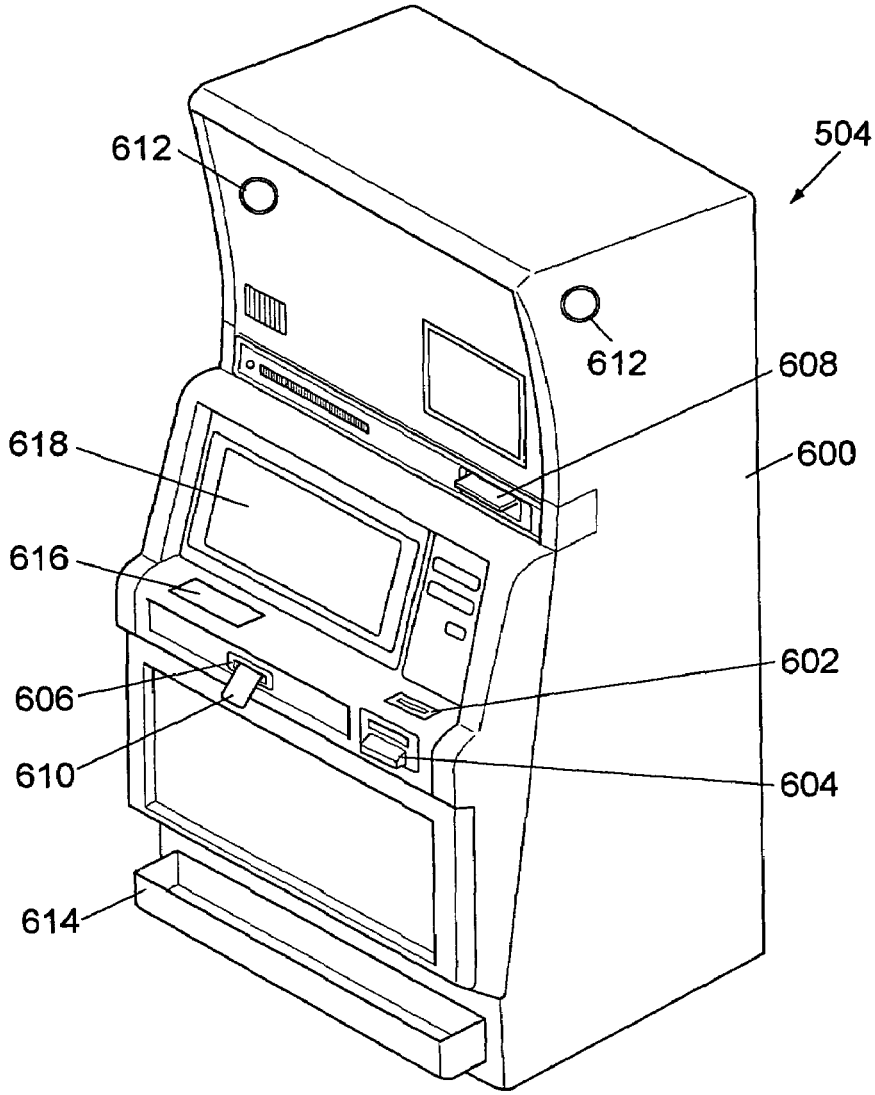
FIG. 6 is a perspective view of an embodiment of one of the gaming units shown schematically in FIG. 5.

FIG. 6 is a perspective view of one possible embodiment of one or more of the gaming units 504. Although the following description addresses the design of the gaming units 504, it should be understood that the gaming units 512 may have the same design as the gaming units 504 described below. It should be understood that the design of one or more of the gaming units 504 may be different than the design of other gaming units 504, and that the design of one or more of the gaming units 512 may be different than the design of other gaming units 512. Each gaming unit 504 may be any type of casino gaming unit and may have various different structures and methods of operation. For exemplary purposes, various designs of the gaming units 504 are described below, but it should be understood that numerous other designs may be utilized.

Referring to FIG. 6, the casino gaming unit 504 may include a housing or cabinet 600 and one or more input devices, which may include a coin slot or acceptor 602, a paper currency acceptor 604, a ticket reader/printer 606 and a card reader 608, which may be used to input value to the gaming unit 504. A value input device may include any device that can accept value from a customer. As used herein, the term "value" may encompass gaming tokens, coins, paper currency, ticket vouchers, credit or debit cards, smart cards, and any other object representative of value.

If provided on the gaming unit 504, the ticket reader/printer 606 may be used to read and/or print or otherwise encode ticket vouchers 610. The ticket vouchers 610 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 610 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 610 could be printed with an optically readable material such as ink, or data on the ticket vouchers 610 could be magnetically encoded. The ticket reader/printer 606 may be provided with the ability to both read and print ticket vouchers 610, or it may be provided with the ability to only read or only print or encode ticket vouchers 610. In the latter case, for example, some of the gaming units 504 may have ticket printers 606 that may be used to print ticket vouchers 610, which could then be used by a player in other gaming units 504 that have ticket readers 606.

If provided, the card reader 608 may include any type of card reading device, such as a magnetic card reader or an optical card reader, and may be used to read data from a card offered by a player, such as a credit card or a player tracking card. If provided for player tracking purposes, the card reader 608 may be used to read data from, and/or write data to, player tracking cards that are capable of storing data representing the identity of a player, the identity of a casino, the player's gaming habits, etc.

The gaming unit 504 may include one or more audio speakers 612, a coin payout tray 614, an input control panel 616, and a color video display unit 618 for displaying images relating to the game or games provided by the gaming unit 504. The audio speakers 612 may generate audio representing sounds such as the noise of spinning slot machine reels, a dealer's voice, music, announcements or any other audio related to a casino game. The input control panel 616 may be provided with a plurality of pushbuttons or touch-sensitive areas that may be pressed by a player to select games, make wagers, make gaming decisions, etc.

Figure 6A:
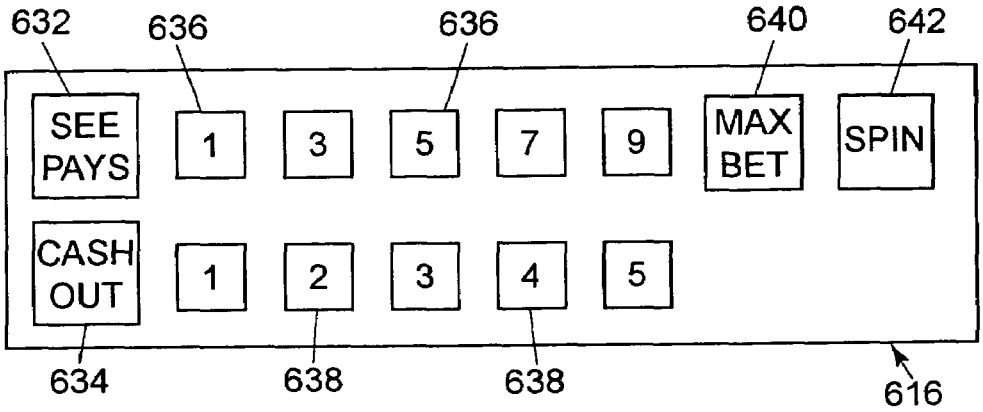
FIG. 6A illustrates an embodiment of a control panel for the gaming unit of FIG. 6.

FIG. 6A illustrates one possible embodiment of the control panel 616, which may be used where the gaming unit 504 is a slot machine having a plurality of mechanical or "virtual" reels. Referring to FIG. 6A, the control panel 616 may include a "See Pays" button 632 that, when activated, causes the display unit 618 to generate one or more display screens showing the odds or payout information for the game or games provided by the gaming unit 504. As used herein, the term "button" is intended to encompass any device that allows a player to make an input, such as an input device that must be depressed to make an input selection or a display area that a player may simply touch. The control panel 616 may include a "Cash Out" button 634 that may be activated when a player decides to terminate play on the gaming unit 504, in which case the gaming unit 504 may return value to the player, such as by returning a number of coins to the player via the payout tray 614.

If the gaming unit 504 provides a slots game having a plurality of reels and a plurality of paylines which define winning combinations of reel symbols, the control panel 616 may be provided with a plurality of selection buttons 636, each of which allows the player to select a different number of paylines prior to spinning the reels. For example, five buttons 636 may be provided, each of which may allow a player to select one, three, five, seven or nine paylines.

If the gaming unit 504 provides a slots game having a plurality of reels, the control panel 616 may be provided with a plurality of selection buttons 638 each of which allows a player to specify a wager amount for each payline selected. For example, if the smallest wager accepted by the gaming unit 504 is a quarter ($0.25), the gaming unit 504 may be provided with five selection buttons 638, each of which may allow a player to select one, two, three, four or five quarters to wager for each payline selected. In that case, if a player were to activate the "5" button 636 (meaning that five paylines were to be played on the next spin of the reels) and then activate the "3" button 638 (meaning that three coins per payline were to be wagered), the total wager would be $3.75 (assuming the minimum bet was $0.25).

The control panel 616 may include a "Max Bet" button 640 to allow a player to make the maximum wager allowable for a game. In the above example, where up to nine paylines were provided and up to five quarters could be wagered for each payline selected, the maximum wager would be 45 quarters, or $11.25. The control panel 616 may include a spin button 642 to allow the player to initiate spinning of the reels of a slots game after a wager has been made.

In FIG. 6A, a rectangle is shown around the buttons 632, 634, 636, 638, 640, 642. It should be understood that rectangle simply designates, for ease of reference, an area in which the buttons 632, 634, 636, 638, 640, 642 may be located. Consequently, the term "control panel" should not be construed to imply that a panel or plate separate from the housing 600 of the gaming unit 504 is required, and the term "control panel" may encompass a plurality or grouping of player activatable buttons.

Although one possible control panel 616 is described above, it should be understood that different buttons could be utilized in the control panel 616, and that the particular buttons used may depend on the game or games that could be played on the gaming unit 504. Although the control panel 616 is shown to be separate from the display unit 618, it should be understood that the control panel 616 could be generated by the display unit 618. In that case, each of the buttons of the control panel 616 could be a colored area generated by the display unit 618, and some type of mechanism may be associated with the display unit 618 to detect when each of the buttons was touched, such as a touch-sensitive screen.

Gaming Unit Electronics

Figure 6B:
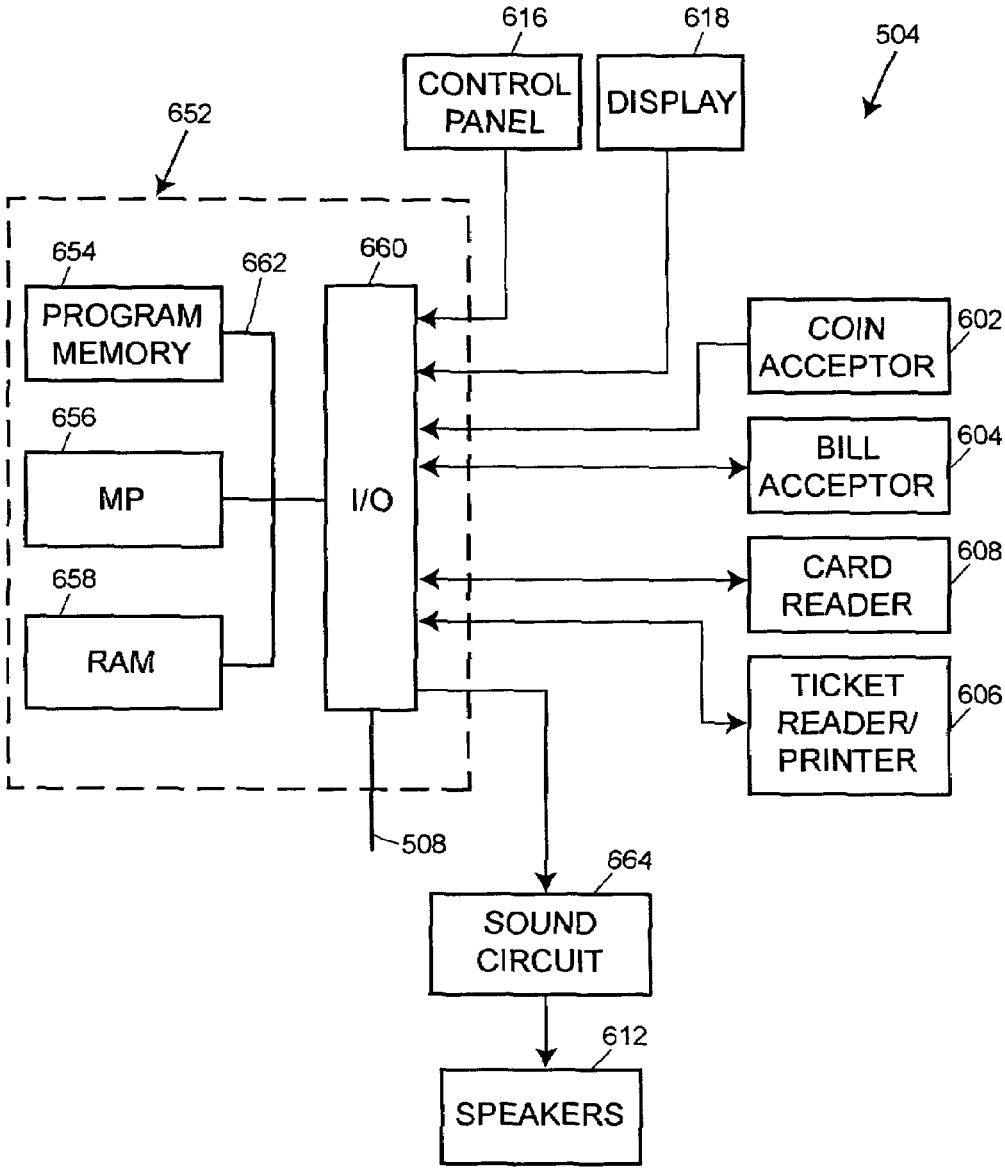
FIG. 6B is a block diagram of the electronic components of the gaming unit of FIG. 6.

FIG. 6B is a block diagram of a number of components that may be incorporated in the gaming unit 504. Referring to FIG. 6B, the gaming unit 504 may include a controller 652 that may comprise a program memory 654, a microcontroller or microprocessor (MP) 656, a random-access memory (RAM) 658 and an input/output (I/O) circuit 660, all of which may be communicatively interconnected via an address/data bus 662.

It should be appreciated that although only one microprocessor 656 is shown, the controller 652 may include multiple microprocessors 656. Similarly, the memory of the controller 652 may include multiple RAMs 658 and multiple program memories 654. Although the I/O circuit 660 is shown as a single block, it should be appreciated that the I/O circuit 660 may include a number of different types of I/O circuits. The RAM(s) 658 and program memories 654 may be implemented as semiconductor memories, magnetically readable memories, and/or optically readable memories, for example.

Although the program memory 654 is shown in FIG. 6B as a read-only memory (ROM) 654, the program memory of the controller 652 may be a read/write or alterable memory, such as a hard disk. In the event a hard disk is used as a program memory, the address/data bus 662 shown schematically in FIG. 6B may comprise multiple address/data buses, which may be of different types, and there may be an I/O circuit disposed between the address/data buses.

FIG. 6B illustrates that the control panel 616, the coin acceptor 602, the bill acceptor 604, the card reader 608 and the ticket reader/printer 606 may be operatively coupled to the I/O circuit 660, each of those components being so coupled by either a unidirectional or bidirectional, single-line or multiple-line data link, which may depend on the design of the component that is used. The speaker(s) 612 may be operatively coupled to a sound circuit 664, that may comprise a voice- and sound-synthesis circuit or that may comprise a driver circuit. The sound-generating circuit 664 may be coupled to the I/O circuit 660. In addition, the display 618 may be operatively coupled to the I/O circuit 660 to generate text, graphics or other images associated with game play and operation.

As shown in FIG. 6B, the components 602, 604, 606, 608, 616, 618, 664 may be connected to the I/O circuit 660 via a respective direct line or conductor. Different connection schemes could be used. For example, one or more of the components shown in FIG. 6B may be connected to the I/O circuit 660 via a common bus or other data link that is shared by a number of components. Furthermore, some of the components may be directly connected to the microprocessor 656 without passing through the I/O circuit 660. The I/O circuit 660, in turn, may be connected to additional gaming units 504, 512 via the network data link 508 or any other suitable data bus or link.

Overall Operation of Gaming Unit

One manner in which one or more of the gaming units 504 (and one or more of the gaming units 512) may operate is described below in connection with a number of flowcharts which represent a number of portions or routines of one or more computer programs, which may be stored in one or more of the memories of the controller 652. The computer program(s) or portions thereof may be stored remotely, outside of the gaming unit 504, and may control the operation of the gaming unit 504 from a remote location. Such remote control may be facilitated with the use of a wireless connection, or by an Internet interface that connects the gaming unit 504 with a remote computer (such as one of the network computers 506, 514) having a memory in which the computer program portions are stored. The computer program portions may be written in any high level language such as C, C++, C#, Java or the like or any low-level assembly or machine language. By storing the computer program portions therein, various portions of the memories 654, 656 are physically and/or structurally configured in accordance with computer program instructions.

Figure 7:
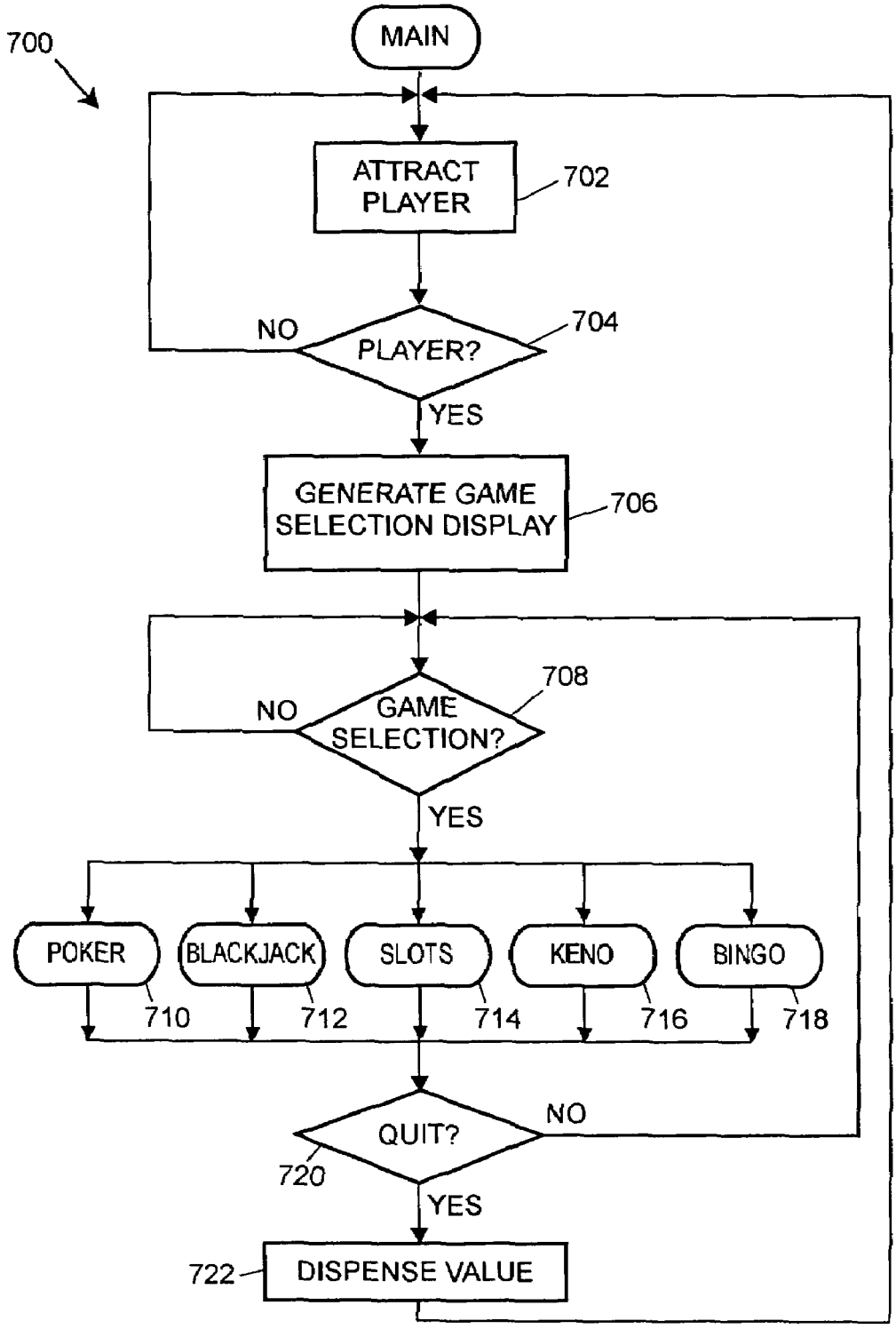
FIG. 7 is a flowchart of an embodiment of a main routine that may be performed during operation of one or more of the gaming units.

FIG. 6 is a flowchart of a main operating routine 700 that may be stored in the memory of the controller 652. Referring to FIG. 7, the main routine 700 may begin operation at block 702 during which an attraction sequence may be performed in an attempt to induce a potential player in a casino to play the gaming unit 504. The attraction sequence may be performed by displaying one or more video images on the display unit 618 and/or causing one or more sound segments, such as voice or music, to be generated via the speakers 612. The attraction sequence may include a scrolling list of games that may be played on the gaming unit 504 and/or video images of various games being played, such as video poker, video blackjack, video slots, video keno, video bingo, etc.

During performance of the attraction sequence, if a potential player makes any input to the gaming unit 504 as determined at block 204, the attraction sequence may be terminated and a game-selection display may be generated on the display unit 618 at block 706 to allow the player to select a game available on the gaming unit 504. The gaming unit 504 may detect an input at block 704 in various ways. For example, the gaming unit 504 could detect if the player presses any button on the gaming unit 504; the gaming unit 504 could determine if the player deposited one or more coins into the gaming unit 504; the gaming unit 504 could determine if player deposited paper currency into the gaming unit; etc.

The game-selection display generated at block 706 may include, for example, a list of video games that may be played on the gaming unit 504 and/or a visual message to prompt the player to deposit value into the gaming unit 504. While the game-selection display is generated, the gaming unit 504 may wait for the player to make a game selection. Upon selection of one of the games by the player as determined at block 708, the controller 652 may cause one of a number of game routines to be performed to allow the selected game to be played. For example, the game routines could include a video poker routine 710, a video blackjack routine 712, a slots routine 714, a video keno routine 716, and a video bingo routine 718. At block 708, if no game selection is made within a given period of time, the operation may branch back to block 702.

After one of the routines 710, 712, 714, 716, 718 has been performed to allow the player to play one of the games, block 720 may be utilized to determine whether the player wishes to terminate play on the gaming unit 504 or to select another game. If the player wishes to stop playing the gaming unit 504, which wish may be expressed, for example, by selecting a "Cash Out" button, the controller 652 may dispense value to the player at block 722 based on the outcome of the game(s) played by the player. The operation may then return to block 702 If the player did not wish to quit as determined at block 720, the routine may return to block 708 where the game-selection display may again be generated to allow the player to select another game.

It should be noted that although five gaming routines are shown in FIG. 7, a different number of routines could be included to allow play of a different number of games, such as a lottery game or a word-based game. The gaming unit 504 may also be programmed to allow play of different games.

Figure 7A:
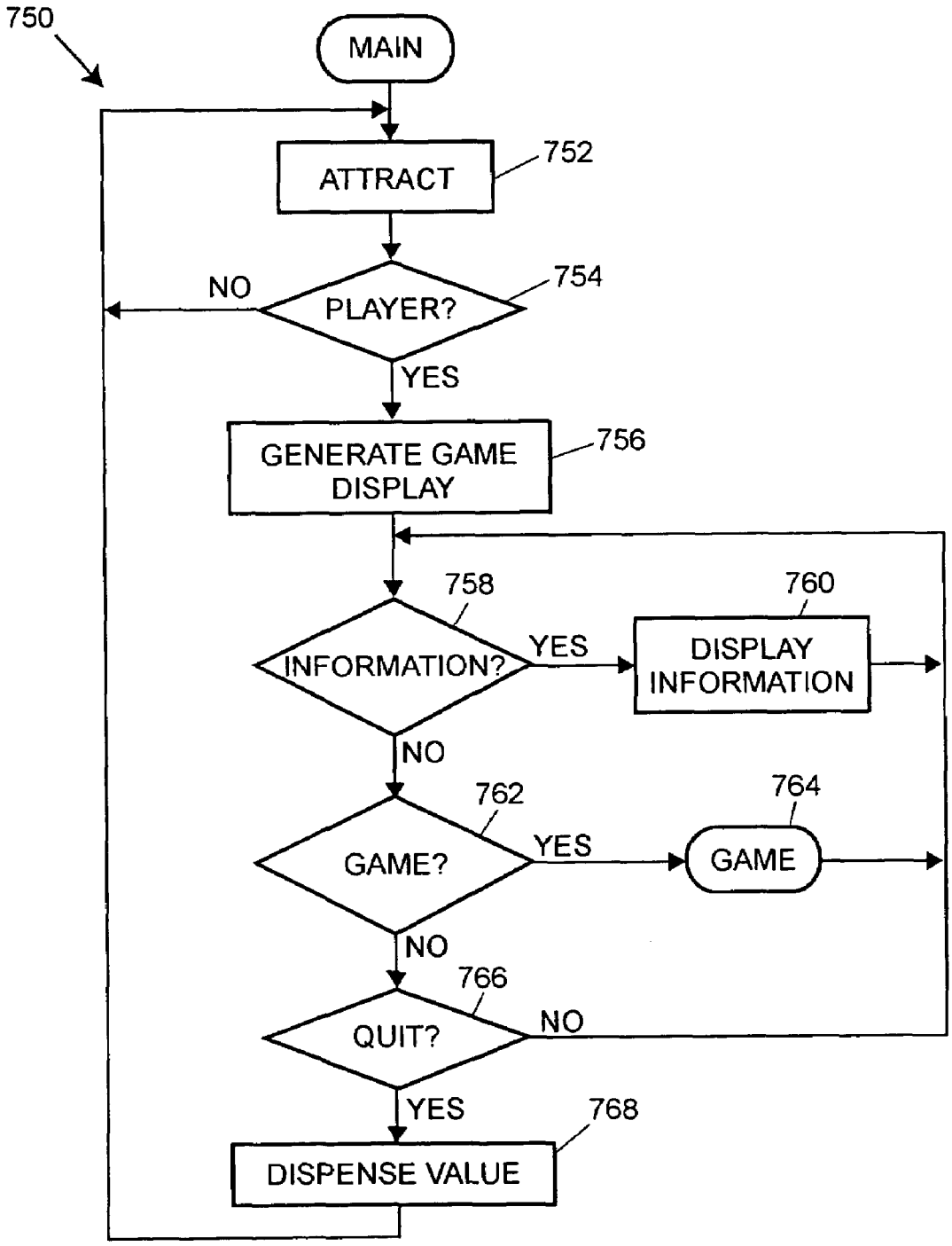
FIG. 7A is a flowchart of an alternate embodiment of a main routine that may be performed during operation of one or more of the gaming units.

FIG. 7A is a flowchart of an alternative main operating routine 750 that may be stored in the memory of the controller 652. The main routine 750 may be utilized for gaming units 504 that are designed to allow play of only a single game or single type of game. Referring to FIG. 7A, the main routine 750 may begin operation at block 752 during which an attraction sequence may be performed in an attempt to induce a potential player in a casino to play the gaming unit 504. The attraction sequence may be performed by displaying one or more video images on the display unit 618 and/or causing one or more sound segments, such as voice or music, to be generated via the speakers 612.

During performance of the attraction sequence, if a potential player makes any input to the gaming unit 504 as determined at block 754, the attraction sequence may be terminated and a game display may be generated on the display unit 618 at block 756. The game display generated at block 756 may include, for example, an image of the casino game that may be played on the gaming unit 504 and/or a visual message to prompt the player to deposit value into the gaming unit 504. At block 758, the gaming unit 504 may determine if the player requested information concerning the game, in which case the requested information may be displayed at block 760. Block 762 may be used to determine if the player requested initiation of a game, in which case a game routine 764 may be performed. The game routine 764 could be any one of the game routines disclosed herein, such as one of the five game routines 710, 712, 714, 716, 718, or another game routine.

After the routine 764 has been performed to allow the player to play the game, block 766 may be utilized to determine whether the player wishes to terminate play on the gaming unit 504. If the player wishes to stop playing the gaming unit 504, which wish may be expressed, for example, by selecting a "Cash Out" button, the controller 652 may dispense value to the player at block 768 based on the outcome of the game(s) played by the player. The operation may then return to block 752. If the player did not wish to quit as determined at block 766, the operation may return to block 758.

Video Poker

Figure 8:
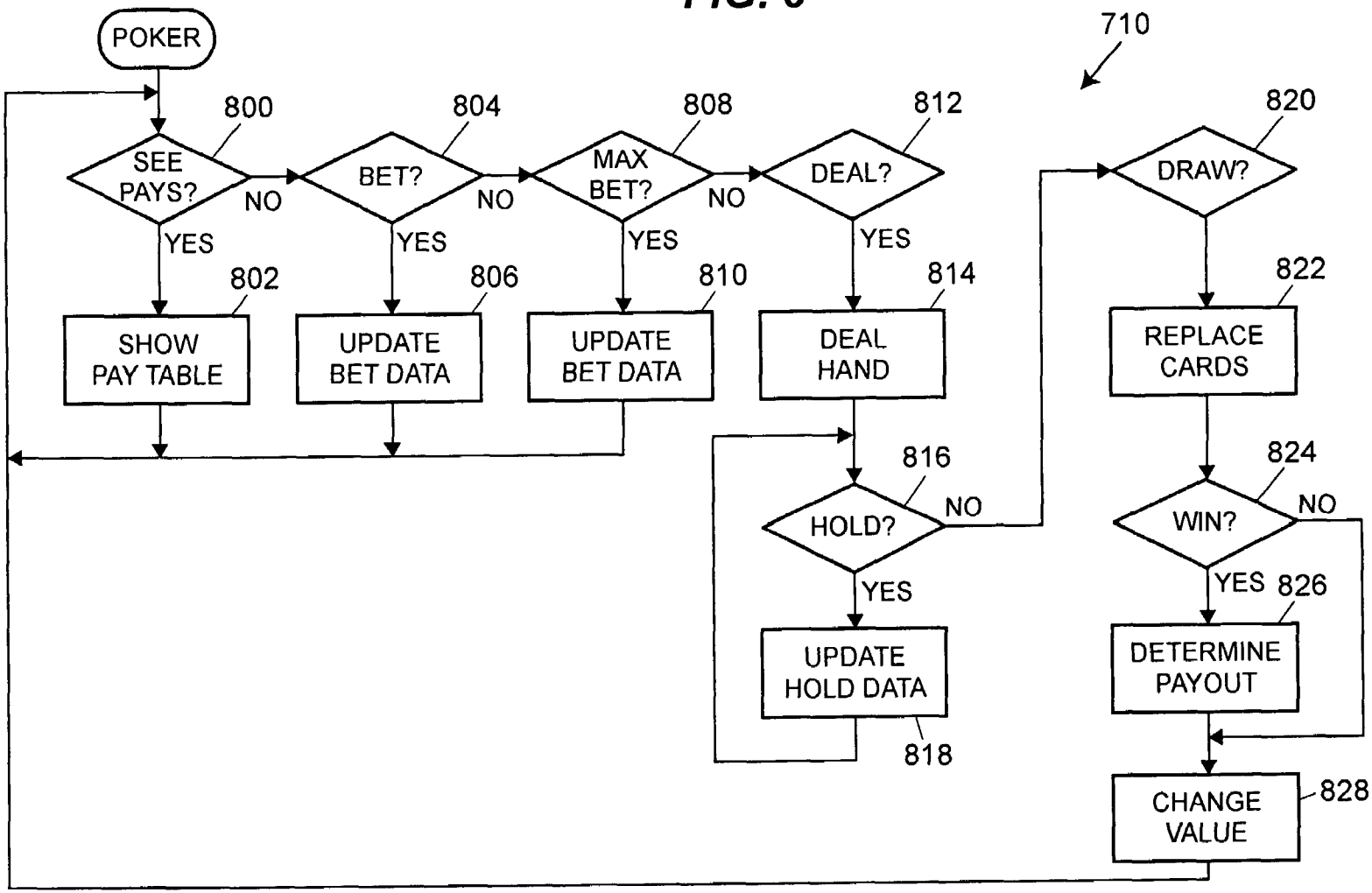
FIG. 8 is a flowchart of an embodiment of a video poker routine that may be performed by one or more of the gaming units.

FIG. 8 is a flowchart of the video poker routine 210 which may be stored in the main program memory 654. Referring to FIG. 8, at block 800, the routine may determine whether the player has requested payout information, which may be referred to as "See Pays", in which case at block 802 the routine may cause one or more pay tables to be displayed on the display unit 618. At block 804, the routine may determine whether the player has made a bet, in which case at block 806 bet data corresponding to the bet made by the player may be stored in the memory of the controller 652. At block 808, the routine may determine whether the player has elected to bet the maximum number of credits, in which case at block 810 bet data corresponding to the maximum allowable bet may be stored in the memory of the controller 652.

At block 812, the routine may determine if the player desires a new hand to be dealt. In that case, at block 814 a video poker hand may be "dealt" by causing the display unit 618 to generate playing card images. After the hand is dealt, at block 816 the routine may determine if the player wishes to "Hold" any cards, in which case data regarding which of the playing card images are to be "held" may be stored in the controller 652 at block 818. If the player selects "Deal/Draw" as determined at block 820, each of the playing card images that was not "held" may be caused to disappear from the display unit 618 and to be replaced by a new, randomly selected, playing card image at block 822.

At block 824, the routine may determine whether the poker hand represented by the playing card images currently displayed is a winner. That determination may be made by comparing data representing the currently displayed poker hand with data representing all possible winning hands, which may be stored in the memory of the controller 652. If there is a winning hand, a payout value corresponding to the winning hand may be determined at block 826. At block 828, the player's cumulative value or number of credits may be updated by subtracting the bet made by the player and adding, if the hand was a winner, the payout value determined at block 826. The cumulative value or number of credits may also be displayed on the display unit 616.

Although the video poker routine 710 is described above in connection with a single poker hand of five cards, the routine 710 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 8A:
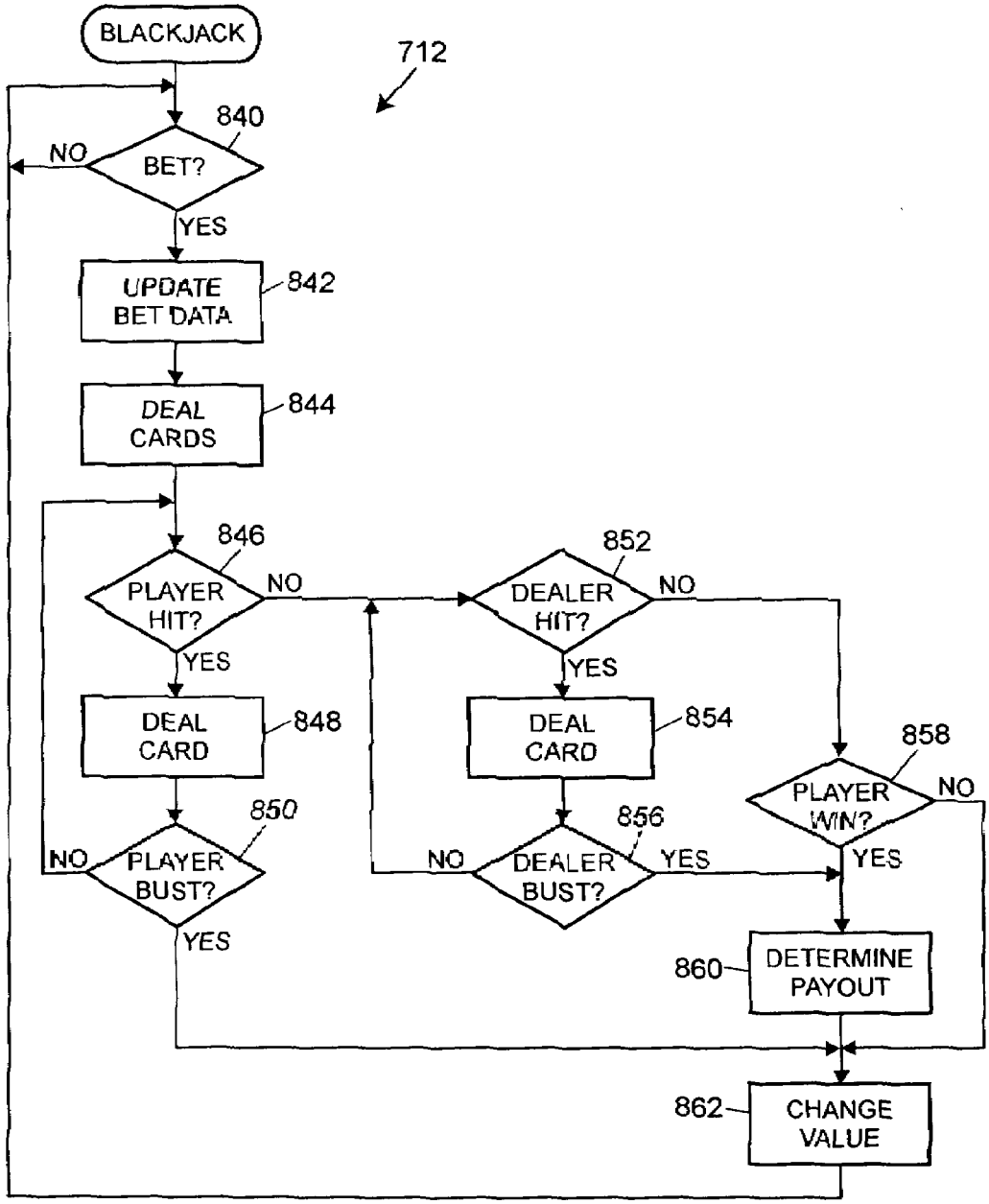
FIG. 8A is a flowchart of an embodiment of a video blackjack routine that may be performed by one or more of the gaming units.

FIG. 8A is a flowchart of the video blackjack routine 712 which may be stored on the main program memory 654. Referring to FIG. 8A, the video blackjack routine 712 may begin at block 840 where it may determine whether a bet has been made by the player. For example, the player may choose to wager one credit, multiple credits or the maximum number of credits. At block 842, bet data corresponding to the bet made at block 840 may be stored in the memory of the controller 652. At block 844, a dealer's hand and a player's hand may be "dealt" by making the playing card images appear on the display unit 618.

At block 846, the player may be allowed to be "hit," in which case at block 848 another card will be dealt to the player's hand by making another playing card image appear in the display unit 618. If the player is hit, block 850 may determine if the player has "bust," or exceeded 21. If the player has not bust, blocks 846 and 848 may be performed again to allow the player to be hit again.

If the player decides not to hit, at block 852 the routine may determine whether the dealer should be hit. Whether the dealer hits may be determined in accordance with predetermined rules, such as the dealer always hit if the dealer's hand totals 15 or less. If the dealer hits, at block 854 the dealer's hand may be dealt another card by making another playing card image appear in the display unit 618. At block 856 the routine may determine whether the dealer has bust. If the dealer has not bust, blocks 852, 854 may be performed again to allow the dealer to be hit again.

If the dealer does not hit, at block 858 the outcome of the blackjack game and a corresponding payout may be determined based on, for example, whether the player or the dealer has the higher hand that does not exceed 21. If the player has a winning hand, a payout value corresponding to the winning hand may be determined at block 860. At block 862, the player's cumulative value or number of credits may be updated by subtracting the bet made by the player and adding, if the player won, the payout value determined at block 860. The cumulative value or number of credits may also be displayed in the display unit 618.

Slots

Figure 9:
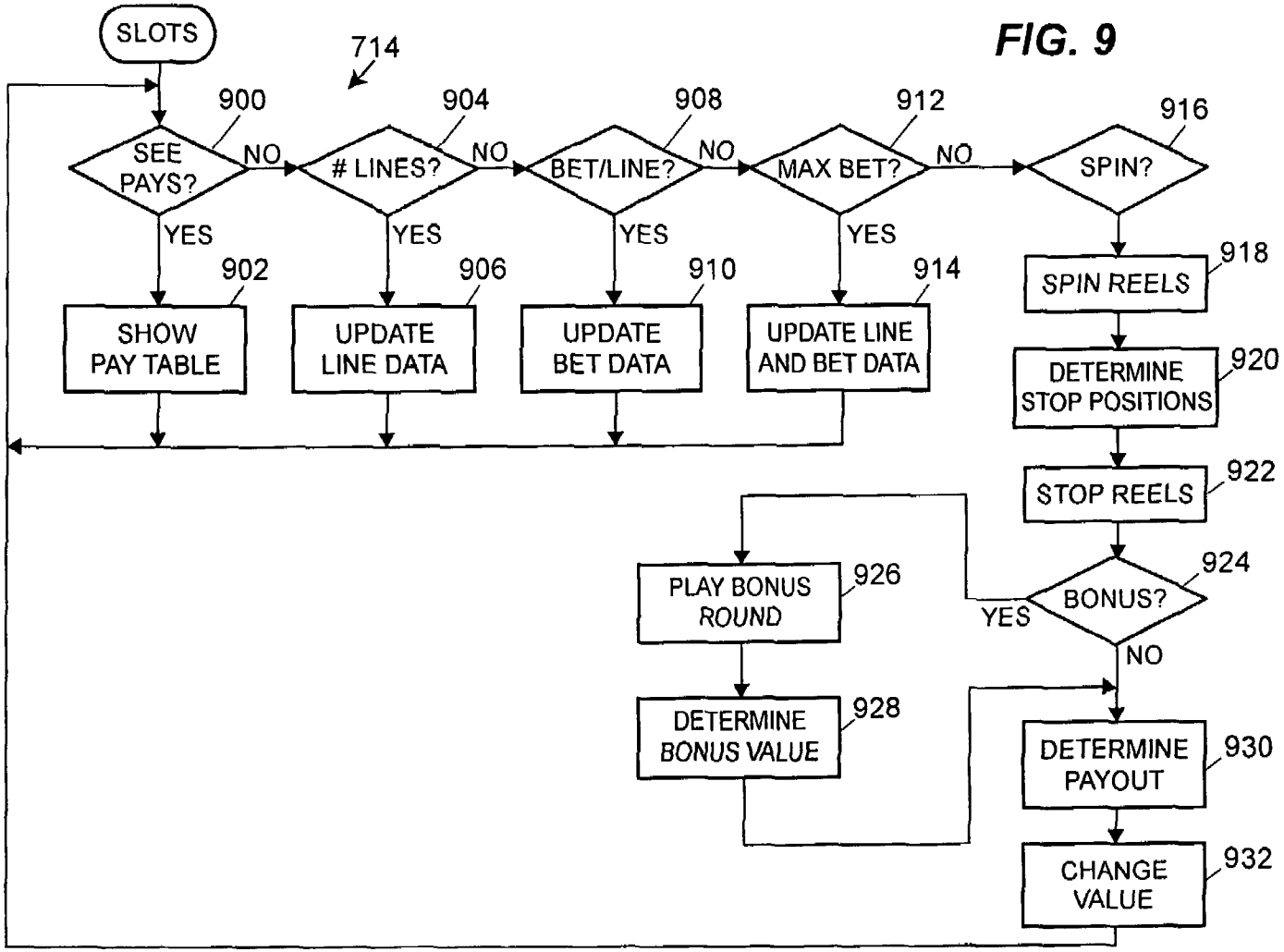
FIG. 9 is a flowchart of an embodiment of a slots routine that may be performed by one or more of the gaming units.

FIG. 9 is a flowchart of the slots routine 714 which may be stored in the main program memory 454. Referring to FIG. 9, at block 900, the routine may determine whether the player has requested payout information, which may be referred to as "See Pays", in which case at block 902 the routine may cause one or more pay tables to be displayed on the display unit 618. At block 904, the routine may determine whether the player has chosen to make a payline-selection, in which case at block 906 data corresponding to the number of paylines selected by the player may be stored in the memory of the controller 652. At block 912, the routine may determine whether the player has made a wager, in which case at block 910 data corresponding to the amount wagered per payline may be stored in the memory of the controller 652. At block 912, the routine may determine whether the player has chosen to make the "Max Bet", in which case at block 914 bet data (which may include both payline data and bet-per-payline data) corresponding to the maximum allowable bet may be stored in the memory of the controller 652.

If the player selects "Spin" as determined at block 916, at block 918 the routine may cause images of slot machine reels to begin "spinning" so as to simulate the appearance of a plurality of spinning mechanical slot machine reels. At block 920, the routine may determine the positions at which the slot machine reel images will stop, or the particular symbol images that will be displayed when the reel images stop spinning. At block 922, the routine may stop the reel images from spinning by displaying stationary reel images and images of three symbols for each stopped reel image. The virtual reels may be stopped from left to right, from the perspective of the player, or in any other manner or sequence.

The routine may provide for the possibility of a bonus game or round if certain conditions are met, such as the display in the stopped reel images of a particular symbol. If there is such a bonus condition as determined at block 494, the routine may proceed to block 926 where a bonus round may be played. The bonus round may be a different game than slots, and many other types of bonus games could be provided. If the player wins the bonus round, or receives additional credits or points in the bonus round, a bonus value may be determined at block 928. A payout value corresponding to outcome of the slots game and/or the bonus round may be determined at block 930. At block 932, the player's cumulative value or number of credits may be updated by subtracting the bet made by the player and adding, if the slot game and/or bonus round was a winner, the payout value determined at block 930.

Although the above routine has been described as a virtual slot machine routine in which slot machine reels are represented as images on the display unit 618, actual slot machine reels that are capable of being spun may be utilized instead.

Video Keno

Figure 9A:
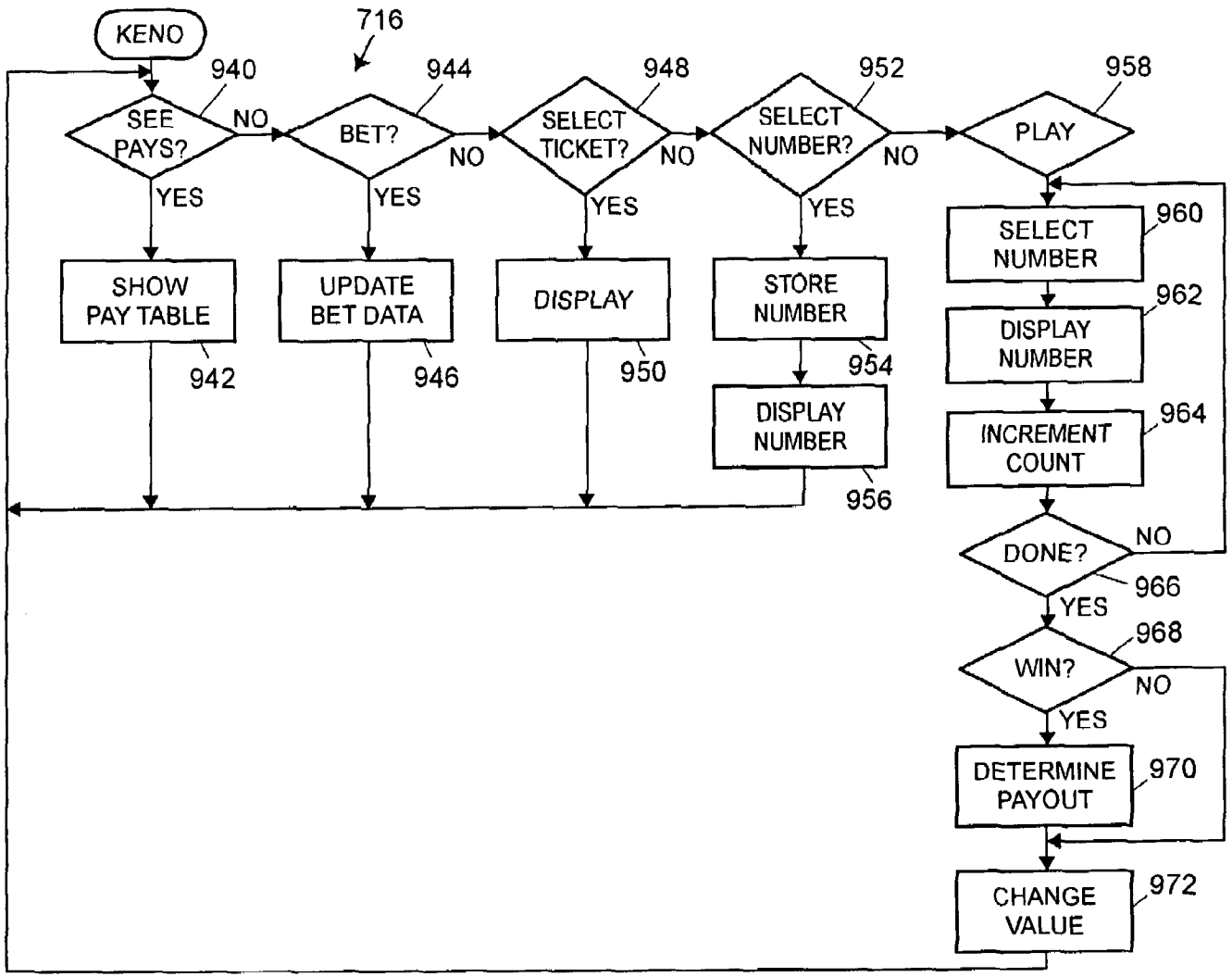
FIG. 9A is a flowchart of an embodiment of a video keno routine that may be performed by one or more of the gaming units.

FIG. 9A is a flowchart of the video keno routine 716 which may be stored in the main program memory 654. The keno routine 716 may be utilized in connection with a single gaming unit 504 where a single player is playing a keno game, or the keno routine 716 may be utilized in connection with multiple gaming units 504 where multiple players are playing a single keno game. In the latter case, one or more of the acts described below may be performed either by the controller 652 in each gaming unit or by one of the network computer 506, 514 to which multiple gaming units 504 are operatively connected.

Referring to FIG. 9A, at block 940, the routine may determine whether the player has requested payout information, which may be referred to as "See Pays", in which case at block 942 the routine may cause one or more pay tables to be displayed on the display unit 618. At block 944, the routine may determine whether the player has made a bet. For example, the player may choose to wager one credit, or may choose to bet the maximum number of credits, in which case at block 946 bet data corresponding to the bet made by the player may be stored in the memory of the controller 652. After the player has made a wager, at block 948 the player may select a keno ticket, and at block 950 the ticket may be displayed on the display unit 618. At block 952, the player may select one or more game numbers, which may be within a range set by the casino. After being selected, the player's game numbers may be stored in the memory of the controller 652 at block 954 and may be included in the image on the display unit 618 at block 856. After a certain amount of time, the keno game may be closed to additional players (where a number of players are playing a single keno game using multiple gambling units 504).

If play of the keno game is to begin as determined at block 958, at block 960 a game number within a range set by the casino may be randomly selected either by the controller 652 or a central computer operatively connected to the controller, such as one of the network computers 506, 514. At block 962, the randomly selected game number may be displayed on the display unit 618 and the display units 618 of other gaming units 504 (if any) which are involved in the same keno game. At block 964, the controller 652 (or the central computer noted above) may increment a count which keeps track of how many game numbers have been selected at block 960.

At block 966, the controller 652 (or one of the network computers 506, 514) may determine whether a maximum number of game numbers within the range have been randomly selected. If not, another game number may be randomly selected at block 960. If the maximum number of game numbers has been selected, at block 968 the controller 652 (or a central computer) may determine whether there are a sufficient number of matches between the game numbers selected by the player and the game numbers selected at block 960 to cause the player to win. The number of matches may depend on how many numbers the player selected and the particular keno rules being used.

If there are a sufficient number of matches, a payout may be determined at block 970 to compensate the player for winning the game. The payout may depend on the number of matches between the game numbers selected by the player and the game numbers randomly selected at block 960. At block 972, the player's cumulative value or number of credits may be updated by subtracting the bet made by the player and adding, if the keno game was won, the payout value determined at block 970. The cumulative value or number of credits may also be displayed in the display unit 618.

Video Bingo

Figure 10:
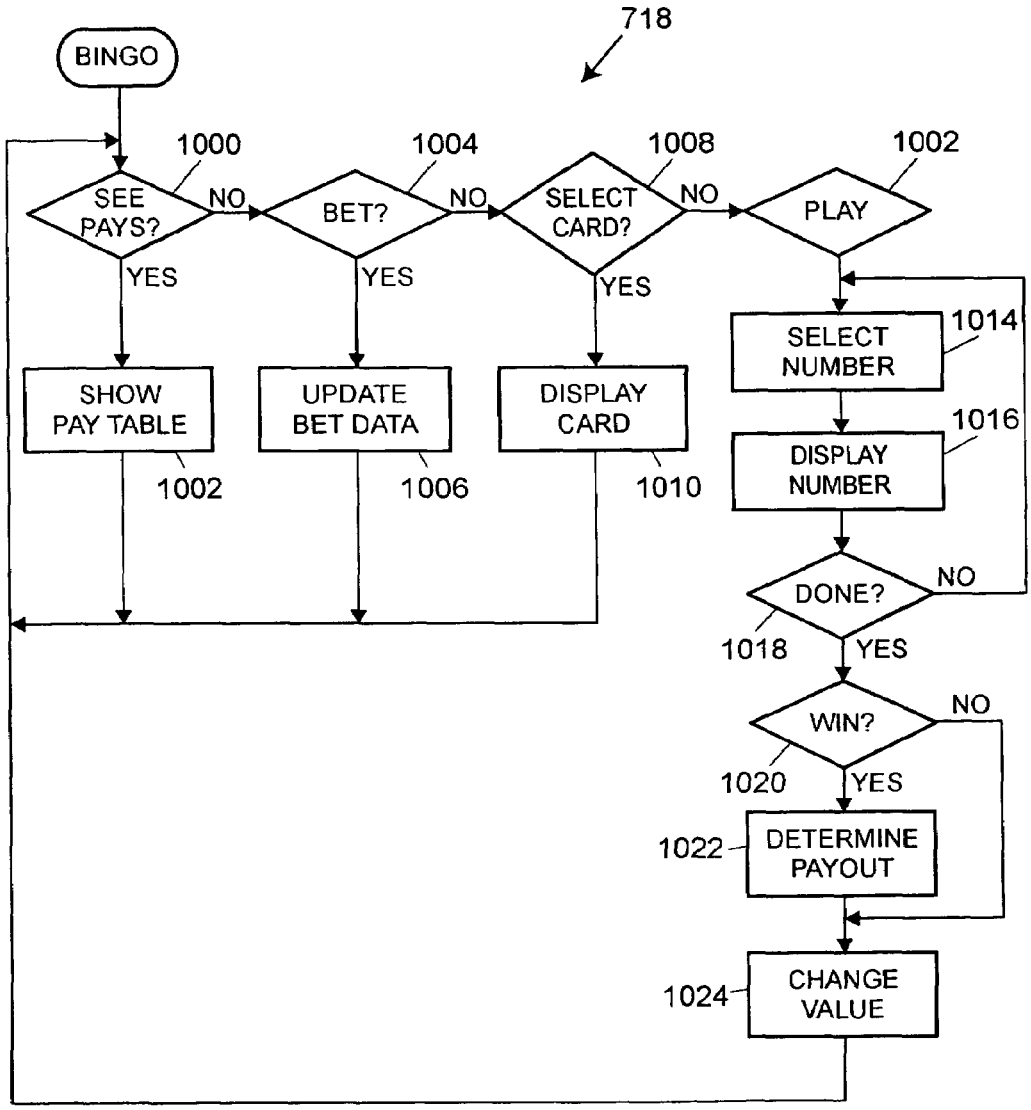
FIG. 10 is a flowchart of an embodiment of a video bingo routine that may be performed by one or more of the gaming units.

FIG. 10 is a flowchart of the video bingo routine 718 which may be stored in the main program memory 654. The bingo routine 718 may be utilized in connection with a single gaming unit 504 where a single player is playing a bingo game, or the bingo routine 718 may be utilized in connection with multiple gaming units 504 where multiple players are playing a single bingo game. In the latter case, one or more of the acts described below may be performed either by the controller 652 in each gaming unit 504 or by one of the network computers 506, 514 to which multiple gaming units 504 are operatively connected.

Referring to FIG. 10, at block 1000, the routine may determine whether the player has requested payout information, which may be referred to as "See Pays", in which case at block 1002 the routine may cause one or more pay tables to be displayed on the display unit 618. At block 1004, the routine may determine whether the player has made a bet. For example, the player may choose to wager one credit, or may choose to bet the maximum number of credits, in which case at block 1006 bet data corresponding to the bet made by the player may be stored in the memory of the controller 652.

After the player has made a wager, at block 1008 the player may select a bingo card, which may be generated randomly. The player may select more than one bingo card, and there may be a maximum number of bingo cards that a player may select. After play is to commence as determined at block 1012, at block 1014 a bingo number may be randomly generated by the controller 652 or a central computer such as one of the network computers 506, 514. At block 1016, the bingo number may be displayed on the display unit 618 and the display units 618 of any other gaming units 504 involved in the bingo game.

At block 1018, the controller 652 (or a central computer) may determine whether any player has won the bingo game. If no player has won, another bingo number may be randomly selected at block 1014. If any player has bingo as determined at block 1018, the routine may determine at block 1020 whether the player playing that gaming unit 504 was the winner. If so, at block 1022 a payout for the player may be determined. The payout may depend on the number of random numbers that were drawn before there was a winner, the total number of winners (if there was more than one player), and the amount of money that was wagered on the game. At block 1024, the player's cumulative value or number of credits may be updated by subtracting the bet made by the player and adding, if the bingo game was won, the payout value determined at block 1022. The cumulative value or number of credits may also be displayed in the display unit 618.

What is claimed is:

1. A lottery terminal apparatus, comprising:

a lottery input unit;

a value input device;

a controller comprising a processor and a memory operatively coupled to said processor, said controller operative with said lottery input unit and said value input device to:

receive a play phrase from a user that includes a plurality of words designated by the user, receive wager data in response to a wager made by the user, assign a prize value to each of the plurality of words in the play phrase designated by the user as a function of the commonality of letters that form each selected word in the play phrase, randomly generate a random string of letters, correlate the random string of letters to the play phrase to determine any words in the play phrase that are formed from the random string of letters, and determine a prize payout value based on the correlation between the words in the play phrase and random string of letters.

2. The lottery terminal apparatus as defined in claim 1 wherein said lottery input unit comprises a lottery play slip reader for importing said play phrase coded onto a lottery play slip.

3. The lottery terminal apparatus as defined in claim 1 wherein said lottery input unit comprises a touch-screen device for receiving said play phrase as inputted by the user.

4. The lottery terminal apparatus as defined in claim 1, wherein said value input device is a card reader for accepting value information encoded onto a readable medium.

5. The lottery terminal apparatus as defined in claim 1, wherein said value input device is communicatively connected to a value acceptor and configured to accept value information communicated from said value acceptor.

6. The lottery terminal apparatus as defined in claim 1, wherein said memory stores a probability distribution indicative of the frequency at which each letter in said play phrase occurs to assign a prize value to said play phrase.

7. The lottery terminal apparatus as defined in claim 1, wherein the random string of letters includes a wildcard that may be substituted for any one of the letters in the words of said play phrase.

8. A lottery game system comprising a plurality of lottery terminal apparatuses as defined in claim 1, said lottery terminal apparatuses being interconnected to form a network of lottery terminal apparatuses.

9. The lottery terminal apparatus as defined in claim 1, wherein said prize value also increases as a function of the number of words in the play phrase or length of the individual words in the play phrase.

10. A lottery ticket, comprising:

a section having a play phrase printed thereon that comprises a plurality of words selected by a user;

a prize value printed on said ticket that is associated with each of the plurality of words in the play phrase, wherein said prize value increases as a function of the commonality of letters that form each of the selected words in the play phrase;

a randomly generated string of letters in a second section beneath a removable cover layer, said cover being selectively removable to reveal said random string of letters; and wherein the user is awarded a prize payout corresponding to the prize value for the words in the play phrase that are formed completely from the randomly generated letters or that contain all of the randomly generated letters.

11. The lottery ticket of claim 10, wherein said random string of letters includes a wildcard that may be substituted for any one of the letters in any of the words of the play phrase.

12. The lottery ticket of claim 10, wherein said prize value also increases as a function of the number of words in the play phrase or length of the individual words in the play phrase.

* * * * *